US008353180B2

(12) United States Patent
Okamoto et al.

(10) Patent No.: US 8,353,180 B2
(45) Date of Patent: Jan. 15, 2013

(54) REFRIGERATING APPARATUS

(75) Inventors: Masakazu Okamoto, Osaka (JP); Tetsuya Okamoto, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 779 days.

(21) Appl. No.: 12/593,600

(22) PCT Filed: Feb. 28, 2008

(86) PCT No.: PCT/JP2008/000383

§ 371 (c)(1),
(2), (4) Date: Sep. 28, 2009

(87) PCT Pub. No.: WO2008/117511

PCT Pub. Date: Oct. 2, 2008

(65) Prior Publication Data

US 2010/0126211 A1 May 27, 2010

(30) Foreign Application Priority Data

Mar. 27, 2007 (JP) ..... 2007-082288
Feb. 22, 2008 (JP) ..... 2008-041025

(51) Int. Cl.
*F25B 43/02* (2006.01)

(52) U.S. Cl. ..... 62/470

(58) Field of Classification Search ..... 62/470, 62/498, 503, 512, 513
See application file for complete search history.

(56) References Cited

U.S. PATENT DOCUMENTS 4,010,378 A * 3/1977 Tharpe et al. ..... 290/2
4,108,618 A * 8/1978 Schneider ..... 96/176
6,418,751 B1 * 7/2002 Telesz et al. ..... 62/503
7,918,096 B2 * 4/2011 Sakitani et al. ..... 62/192

FOREIGN PATENT DOCUMENTS

JP 11-294873 A 10/1999
JP 2003-139420 A 5/2003
JP 2006-38453 A 2/2006
JP 2006-349298 A 12/2009
WO WO 2006/126396 A1 11/2006

OTHER PUBLICATIONS

Partial English translation of JP-11-294873-A dated Oct. 29, 1999.
Partial English translation of JP-2006-349298-A dated Dec. 28, 2006.
Partial English translation of JP-2006-38453-A dated Feb. 9, 2006.

* cited by examiner

*Primary Examiner* — Melvin Jones
(74) *Attorney, Agent, or Firm* — Birch, Stewart, Kolasch & Birch, LLP

(57) ABSTRACT

An on-off valve (70) is provided in an oil feed path (43). When liquid refrigerant enters the oil feed pipe (43) from the oil separator (22), the temperature of the liquid refrigerant whose pressure has been reduced in the on-off valve (70) dramatically decreases. When the amount of such a decrease in temperature detected by a temperature sensor (73) exceeds a specified amount, it is determined that the liquid refrigerant enters the oil feed pipe (43), and the on-off valve (70) is closed.

21 Claims, 12 Drawing Sheets

REFRIGERATING APPARATUS

TECHNICAL FIELD

The present disclosure relates to refrigerating apparatuses performing refrigeration cycles, and particularly relates to a refrigerating apparatus in which oil is separated from refrigerant flowing out from an expander and is sent to the suction side of a compressor.

BACKGROUND ART

Refrigerating apparatuses including refrigerant circuits performing refrigeration cycles by circulating refrigerant have been known conventionally, and are being used widely for indoor air conditioning and refrigerator cooling, for example. Some of the refrigerating apparatuses of this type, expanders are provided in the refrigerant circuits for power recovery in place of expansion valves.

Patent Document 1 discloses a refrigerating apparatus including such an expander. The refrigerating apparatus includes a compressor, a radiator, an expander, and an evaporator which are connected sequentially. Carbon dioxide is filled as refrigerant in a refrigerant circuit. In the refrigerant circuit, polyalkylene glycol is used as refrigerating machine oil for lubricating respective sliding portions of the compressor and the expander. The compressor and the expander are mechanically coupled to each other through a rotary shaft.

During cooling operation of this refrigerating apparatus, the refrigerant discharged from the compressor flows into the expander after dissipating heat in the radiator. In the expander, the expansion power when the refrigerant is expanded is recovered as rotational force of the rotary shaft. The refrigerant in a gas/liquid two-phase state flowing out from the expander flows into an oil separator. Here, the two-phase gas/liquid refrigerant contains oil utilized for lubricating the expander. Therefore, in the oil separator, the oil is separated from the two-phase gas/liquid refrigerant, and is retained in the bottom of the oil separator. The refrigerant from which the oil is separated in the oil separator flows into the evaporator. In the evaporator, the refrigerant absorbs heat from indoor air to cool the indoor air. The refrigerant evaporated in the evaporator is sucked into the compressor to be compressed again.

While, an oil return pipe communicating with the suction side of the compressor is connected to the bottom of the oil separator in Patent Document 1. Accordingly, the oil separated in the oil separator as described above is sucked into the compressor through the oil return pipe to be utilized for lubricating the sliding portions of the compressor. Thus, in this refrigerating apparatus, the oil is separated from the refrigerant on the outflow side of the expander and is sent to the suction side of the compressor. Therefore, this refrigerant apparatus can prevent the oil flowing out from the expander from flowing into the evaporator. Consequently, degradation of the heat transfer performance of the evaporator, which is caused by adhesion of the oil to the heat transfer tubes of the evaporator, can be prevented, thereby ensuring cooling performance of the evaporator.

Patent Document 1: Japanese Unexamined Patent Application Publication No. 2003-139420

SUMMARY

Problems that the Invention is to Solve

As described above, in Patent Document 1, the two-phase gas/liquid refrigerant flowing out from the expander is separated by the oil separator, and the separated oil is sent to the suction side of the compressor through the oil return pipe. However, the amount of the oil retained in the oil separator varies according to the amount of the oil flowing out from the expander, the amount of the oil sent to the compressor through the oil return pipe, and the like. Accordingly, when the amount of the oil retained in the oil separator decreases, the liquid refrigerant in the oil separator may flow into the oil return pipe to be sent to the suction side of the compressor. Consequently, the amount of the refrigerant supplied to the evaporator decreases to reduce the cooling capacity of the evaporator.

The present invention has been made in view of the foregoing, and its objective is to sufficiently retain the liquid refrigerant sent to evaporators (51*a*, 51*b*, 51*c*) from an oil separator (22) provided on the outflow side of an expander.

Means for Solving the Problems

A first example of the present invention is directed to a refrigerating apparatus including a refrigerant circuit (11) including a compressor (32), a radiator (21), an expander (33), and an evaporator (51*a*, 51*b*, 51*c*) for performing a refrigeration cycle, wherein the refrigerant circuit (11) includes an oil separator (22) configured to separate oil from two-phase gas/liquid refrigerant flowing out from the expander (33), and an oil feed path (43) configured to send the oil separated by the oil separator (22) and retained in a bottom of the oil separator (22) to a suction side of the compressor (32). This refrigerating apparatus further includes a refrigerant flow limiting section (70, 71, 73, 75, 80) that limits a flow of fluid flowing in the oil feed path (43) for preventing liquid refrigerant in the oil separator (22) from being sucked to the compressor (32) through the oil feed pipe (43). It is noted that the term, "liquid refrigerant" herein includes both liquid refrigerant contained in two-phase gas/liquid refrigerant and liquid refrigerant in a single phase state.

In the refrigerating apparatus of the first example, a vapor compression refrigeration cycle is performed by circulating the refrigerant in the refrigerant circuit (11). Specifically, in the refrigeration cycle, the refrigerant compressed in the compressor (32) flows into the expander (33) after dissipating heat in the radiator (21). The refrigerant expanded in the expander (33) flows in a gas/liquid two-phase state into the oil separator (22). Here, the two-phase gas/liquid refrigerant contains oil (refrigerating machine oil) utilized for lubricating the sliding portions of the compressor (32) and the expander (33). In the oil separator (22), the oil is separated from the two-phase gas/liquid refrigerant, and is retained in the bottom of the oil separator (22). The refrigerant from which the oil has been separated is sent to the evaporator (51*a*, 51*b*, 51*c*). In the evaporator (51*a*, 51*b*, 51*c*), for example, the refrigerant absorbs heat from indoor air to cool the indoor air. The refrigerant evaporated in the evaporator (51*a*, 51*b* 51*c*) is sucked into the compressor (32) to be compressed again. On the other hand, the oil retained in the oil separator (22) is sucked into the compressor through the oil feed path (43).

Here, in the present example, the refrigerant flow limiting section (70, 71, 73, 75, 80) limits the flow of the liquid refrigerant in the oil separator (22) flowing into the oil feed path (43). Accordingly, in a state where the liquid refrigerant tends to flow into the oil feed path (43) due to a decrease in level of the oil in the oil separator (22), the liquid refrigerant can be prevented from being sent to the suction side of the compressor (32) through the oil feed path (43).

Referring to a second example, in the refrigerating apparatus of the first example, the refrigerant flow limiting section includes a refrigerant detection section (70, 73, 74, 80) that detects entering of the liquid refrigerant from the oil separator (22) to the oil feed path (43), and an opening adjustment mechanism (70) that reduces the opening of the oil feed path (43) when the refrigerant detection section (70, 73, 74, 80) detects entering of the liquid refrigerant.

In the second example, when the liquid refrigerant flows into the oil feed path (43) due to a decrease in amount of the oil in the oil separator (22), the refrigerant detection section (70, 73, 74, 80) detects such inflow of the liquid refrigerant. In association with this detection, the opening of the opening adjustment mechanism (70) is reduced to limit the flow of the liquid refrigerant in the oil feed path (43). Thus, sending the liquid refrigerant to the suction side of the compressor (32) can be suppressed.

Referring to a third example, in the refrigerating apparatus of the second example, the refrigerant detection section includes a pressure reduction mechanism (70) that reduces a pressure of the fluid flowing in the oil feed path (43) and a temperature sensor that detects a temperature of the fluid on a downstream side of the pressure reduction mechanism (70), and the refrigerant detection section is configured to detect entering of the liquid refrigerant to the oil feed path (43) on the basis of a detected temperature of the temperature sensor (73).

To the oil feed path (43) in the third example, the pressure reduction mechanism (70) and the temperature sensor (73) are provided as the refrigerant detection section. Although the pressure reduction mechanism (70) reduces the pressure of the oil when the oil in the oil separator (22) flows into the oil feed path (43), the temperature of the pressure reduced oil hardly decreases. In contrast, when the pressure reduction mechanism (70) reduces the pressure of the liquid refrigerant when the liquid refrigerant in the oil separator (22) flows into the oil feed path (43), the temperature of the pressure reduced liquid refrigerant decreases dramatically. Accordingly, in the present example, whether the liquid refrigerant enters the oil feed path (43) or not is detected by utilizing difference in degree of a temperature decrease accompanied by the pressure reduction between the oil and the liquid refrigerant.

Referring to a fourth example, in the refrigerating apparatus of the second example, the refrigerant detection section includes a heating section (74) that heats the fluid flowing in the oil feed path (43) and a temperature sensor that detects a temperature of the fluid on a downstream side of the heating section (74), and the refrigerant detection section is configured to detect entering of the liquid refrigerant to the oil feed path (43) on the basis of a detected temperature of the temperature sensor (73).

To the oil feed path (43) in the fourth example, the heating section (74) and the temperature sensor (73) are provide as the refrigerant detection section. When the heating section heats the oil when the oil in the oil separator (22) flows into the oil feed path (43), the temperature of the heated oil increases. In contrast, although the heating section (74) heats the liquid refrigerant when the liquid refrigerant in the oil separator (22) flows into the oil feed path (43), the temperature of the heated liquid refrigerant does not vary. In other words, the liquid refrigerant takes only the latent heat for evaporation from the heating section (74), and does not increase in temperature. Thus, in the present example, whether the liquid refrigerant enters the oil feed path (43) or not is detected by utilizing difference between the oil and the liquid refrigerant in degree of a temperature increase accompanied by heating.

Referring to a fifth example, in the refrigerating apparatus of the fourth example, the heating section is configured by a heating heat exchanger (74) that performs heat exchange between the fluid flowing in the oil feed path (43) and the refrigerant on an inflow side of the expander (33).

In the fifth example, the heating heat exchanger (74) is provided as the heating section for heating the fluid flowing in the oil feed path (43). In the heating heat exchanger (74) in the present example, the refrigerant on the inflow side of the expander (33) heats the fluid flowing in the oil feed path (43).

Referring to a sixth example, in the refrigerating apparatus of the fourth example, the heating section is configured by a heating heat exchanger (74) that performs heat exchange between the fluid flowing in the oil feed path (43) and the refrigerant on a discharge side of the compressor (32).

In the heating heat exchanger (74) in the sixth example, the high temperature refrigerant discharged from the compressor (32) heats the fluid flowing in the oil feed path (43).

Referring to a seventh example, in the refrigerating apparatus of the fourth example, the refrigerant circuit (11) includes a high pressure side oil separator (27) that separates the oil from the refrigerant discharged from the compressor (32), and an oil return path (45) that returns the oil separated in the high pressure side oil separator (27) to a suction side of the compressor (32), and the heating section is configured by a heating heat exchanger (74) that performs heat exchange between the fluid flowing in the oil feed path (43) and the oil flowing in the oil return path (45).

In the seventh example, the oil contained in the refrigerant discharged from the compressor (32) flows into the high pressure side oil separator (27). The high pressure side oil separator (27) separates the oil from the refrigerant. The separated oil is returned to the suction side of the compressor (32) through the oil return path (45). Here, in the heating heat exchanger (74) in the present example, the high temperature oil flowing in the oil return path (45) heats the fluid flowing in the oil feed path (43).

Referring to an eighth example, in the refrigerating apparatus of the second example, the refrigerant detection section includes a pressure reduction mechanism (70) that reduces a pressure of the fluid flowing in the oil feed path (43), and a superheat degree detection section (90) that detects a degree of superheat of the refrigerant on a suction side of the compressor (32), and the refrigerant detection section is configured to detect entering of the liquid refrigerant to the oil feed path (43) on the basis of the degree of superheat of the refrigerant detected by the superheat degree detection section (90).

In the eighth example, the superheat degree detection section (90) is provided which detects the degree of superheat of the refrigerant on the suction side of the compressor (32). Even though the pressure reduction mechanism (70) reduces the pressure of the oil when the oil in the oil separator (22) flows into the oil feed path (43), the temperature of the pressure reduced oil hardly decrease. Accordingly, even when the oil flows out from the oil feed path (43) to the suction side of the compressor (32), the degree of superheat of the refrigerant detected by the superheat degree detecting section (90) hardly varies. In contrast, when the pressure reduction mechanism (70) reduces the pressure of the liquid refrigerant when the liquid refrigerant in the oil separator (22) flows into the oil feed path (43), the temperature of the pressure reduced liquid refrigerant decreases dramatically. Accordingly, when the liquid refrigerant flows out from the oil feed path (43) to the suction side of the compressor (32), the degree of superheat of the refrigerant detected by the superheat degree detection section (90) decreases dramatically.

As discussed above, in the present example, whether the liquid refrigerant enters the oil feed path (43) or not is detected by utilizing difference between the oil and the liquid refrigerant in degree of a temperature decrease accompanied by pressure reduction. Further, since the degree of superheat of the refrigerant in the compressor (32) is comparatively stable during steady operation of the refrigerant circuit (11), detection of entering of the liquid refrigerant into the oil feed path (43) on the basis of the degree of superheat of the refrigerant can be ensured.

Referring to a ninth example, in the refrigerating apparatus of the first example, the refrigerant flow limiting section includes an oil amount detection section (71, 80) that detects an amount of the oil in the oil separator (22), and an opening adjustment mechanism (70) that adjusts an opening of the oil feed path (43) according to the amount of the oil detected by the oil amount detection section (71, 80).

In the ninth example, the oil amount detection section (71, 80) detects the amount of the oil retained in the oil separator (22). The opening adjustment mechanism (70) adjusts the opening of the oil feed path (43) according to the oil amount detected by the oil amount detection section (71, 80). Accordingly, in the present example, in a state where the liquid refrigerant tends to flow into the oil feed path (43) due to a decrease in level of the oil in the oil separator (22), the opening adjustment mechanism (70) can reduce the opening of the oil feed path (43). Consequently, sending the liquid refrigerant to the suction side of the compressor (32) can be suppressed.

Referring to a tenth example in the refrigerating apparatus of the ninth example, the oil amount detection section is configured by an oil level detection section (71, 80) that detects a level of the oil in the oil separator (22), and the opening adjustment mechanism (70) is configured to adjust the opening of the oil feed path (43) according to the level of the oil detected by the oil level detection section (71, 80).

In the tenth example, the oil level detection section (71, 80) is used for detecting the amount of the oil in the oil separator (22). The oil level detection section (71, 80) detects a decrease in amount of the oil in the oil separator (22) according to the oil level of this oil. Accordingly, in a state where the oil level becomes comparatively low to allow the liquid refrigerant to tend to flow into the oil feed path (43), the opening adjustment mechanism (70) can reduce the opening of the oil feed path (43). Consequently, sending the liquid refrigerant to the suction side of the compressor (32) can be suppressed.

Referring to a eleventh example, in the refrigerating apparatus in the tenth example, the opening adjustment mechanism is configured to close the oil feed path (43) when the level of the oil detected by the oil level detection section (71, 80) is lower than a predetermined level.

In the eleventh example, when the oil level detected by the oil level detection section (71, 80) becomes lower than the predetermined level, the opening adjustment mechanism (70) closes the oil feed path (43). In other words, when the liquid refrigerant tends to flow into the oil feed path (43) due to a decrease in amount of the oil in the oil separator (22), the opening adjustment mechanism (70) in the closed state prevents the liquid refrigerant from flowing in the oil feed path (43). Consequently, sending the liquid refrigerant to the suction side of the compressor (32) can be suppressed.

Referring to a twelfth example, in the refrigerating apparatus of the first example, the refrigerant flow limiting section includes an on-off valve (70) provided in the oil feed path (43), and a valve control section (80) that temporarily opens the on-off valve (70) every time a predetermined close time Δtc in a state where the on-off valve (70) is closed elapses.

In the twelfth example, the on-off valve (70) as the refrigerant flow limiting section is provided in the oil feed path (43). The valve control section (80) closes the on-off valve (70) until the predetermined close time Δtc elapses. Accordingly, during the close time Δtc, the oil in the oil separator (22) is not sucked to the compressor (32) through the oil feed path (43), and is accumulated in the oil separator (22). While, the valve control section (80) temporarily opens the on-off valve (70) every time the close time Δtc elapses. Consequently, the oil retained in the oil separator (22) is sucked into the compressor (32) through the oil feed path (43). Here, at this time point, the oil has been retained to some amount in the oil separator (22). Therefore, although the on-off valve (70) is opened temporarily, not so large amount of the liquid refrigerant is allowed to be sucked into the compressor (32).

Referring to a thirteenth example, in the refrigerating apparatus of the twelfth example, the refrigerant flow limiting section includes a refrigerant detection section that detects entering of the liquid refrigerant from the oil separator (22) to the oil feed path (43) in a state where the on-off valve (70) is opened, and the valve control section (80) closes the on-off valve (70) in an opened state when the refrigerant detection section (90) detects entering of the liquid refrigerant.

In the thirteenth example, when the refrigerant detection section (90) detects entering of the liquid refrigerant from the oil separator (22) into the oil feed path (43) in the state where the valve control section (80) opens the on-off valve (70), the on-off valve (70) is closed. This can ensure avoidance of outflow of the liquid refrigerant from the oil separator (22). Then, the oil is gradually accumulated in the oil separator (22). Thereafter, when the state where the on-off valve (70) is closed continues for the predetermined close time Δtc, the on-off valve (70) is opened again.

Referring to a fourteenth example, in the refrigerating apparatus of the thirteenth example, the valve control section (80) includes an open time measurement section (82) that measures an open time Δto from time when the on-off valve (70) is opened to time when the on-off valve (70) is closed, and the valve control section (80) corrects the close time Δtc according to the open time Δto measured by the open time measurement section (82).

In the fourteenth example, in a time period between the time when the on-off valve (70) is opened after the predetermined close time Δtc elapses and the time when the refrigerant detection section (90) detects entering of the liquid refrigerant into the oil feed path (43), the open time measurement section (82) measures the open time Δto during which the on-off valve (70) is opened. Then, the valve control section (80) corrects based on this open time Δto the close time Δtc during which the on-off valve (70) should be closed thereafter.

Specifically, if the open time Δto is comparatively short, for example, it can be inferred that the amount of the oil retained in the oil separator (22) was comparatively small at the time when the on-off valve (70) was opened. That is, some more oil could have been retained in the oil separator (22) immediately before the on-off valve (70) was opened. Accordingly, correction of making the close time Δtc to be longer can retain a desired amount of the oil in the oil separator (22). Consequently, the frequency of temporary opening of the on-off valve (70) can be reduced after the correction. Conversely, if the open time Δto is comparatively long, for example, it can be inferred that the amount of the oil retained in the oil separator (22) was comparatively large at the time when the on-off valve (70) was opened. That is, the oil had been retained excessively in the oil separator (22) immediately before the on-off valve (70) was opened. Accordingly, in this case, correction of making the close time Δtc to be shorter can prevent the oil from being excessively retained in the oil separator (22).

Referring to a fifteenth example, in the refrigerating apparatus of the fourteenth example, the valve control section (80) includes an oil flow rate estimating section (83) that estimates a discharge flow rate W of the oil discharged from the oil separator (22) to the oil feed path (43) when the on-off valve (70) is opened, the valve control section (80) is configured to calculate a theoretical open time Δtoi, which is obtained by dividing an oil retention amount Vmax as a reference in the oil separator (22) by the discharge flow rate W, and the valve control section (80) corrects the close time Δtc to be longer when the open time Δto measured by the open time measurement section (82) is shorter than the theoretical open time Δtoi, and corrects the close time Δtc to be shorter when the open time Δto measured by the open time measurement section (82) is longer than the theoretical open time Δtoi.

In the fifteenth example, the oil flow rate estimating section (83) calculates the discharge flow rate W of the oil discharged from the oil separator (22) to the oil feed path (43) at opening of the on-off valve (70). Next, the valve control section (80) divides the oil retention amount Vmax serving as a reference in the oil separator (22) by the oil discharge flow rate W to calculate a theoretical open time Δtoi (=Vmax/W) necessary for discharging the oil in the amount of the oil retention amount Vmax.

Here, if the open time Δto measured by the open time measurement section (82) is shorter than the theoretical open time Δtoi calculated as above, it can be inferred that the oil had not yet been accumulated up to the reference oil retention amount Vmax in the oil separator (22) immediately before the on-off valve (70) was opened. Accordingly, by correcting the close time Δtc to be longer by the valve control section (80), the amount of the oil retained in the oil separator (22) can be increased to approximate the reference oil retention amount Vmax.

Conversely, if the open time Δto measured by the open time measurement section (82) is longer than the theoretical open time Δtoi, it can be inferred that the oil had been retained more than the reference oil retention amount Vmax in the oil separator (22) immediately before the on-off valve (70) was opened. Accordingly, by correcting the close time Δtc to be shorter by the valve control section (80), the amount of the oil retained in the oil separator (22) can be decreased to approximate the reference oil retention amount Vmax.

Referring to a sixteenth example, in the refrigerating apparatus of the fifteenth example, the oil flow rate estimating section (83) is configured to estimate the discharge flow rate W on the basis of a difference between a pressure acting inside the oil separator (22) and a pressure on a suction side of the compressor (32).

In the sixteenth example, at opening of the on-off valve (70), the oil flow rate estimating section (83) estimates the discharge flow rate W of the oil discharged from the oil separator (22) to the oil feed path (43) on the basis of the difference between the pressure acting inside the oil separator (22) and the pressure on the suction side of the compressor (32).

Referring to a seventeenth example, in the refrigerating apparatus of the first example, the refrigerant flow limiting section is configured by a capillary tube (75) provided in the oil feed path (43).

In the seventeenth example, the capillary tube (75) as the refrigerant flow limiting section is provided in the oil feed path (43). When the liquid refrigerant flows into the oil feed path (43) due to a decrease in level of the oil in the oil separator (22), the capillary tube (75) provides predetermined resistance to the liquid refrigerant. Thus, not so large amount of the liquid refrigerant is allowed to be sent to the suction side of the compressor (32).

Referring to an eighteenth example, in the refrigerating apparatus of the first example, the oil separator (22) is configured to separate two-phase gas/liquid refrigerant into liquid refrigerant and gas refrigerant, thereby supplying the liquid refrigerant to the evaporator (51*a*, 51*b*, 51*c*).

In the eighteenth example, the gas/liquid two-phase state refrigerant flowing in the oil separator (22) is separated into the liquid refrigerant and the gas refrigerant. That is, the oil-containing refrigerant flowing in the oil separator (22) is separated into the oil, the liquid refrigerant, and the gas refrigerant. The liquid refrigerant separated in the oil separator (22) is supplied to the evaporator (51*a*, 51*b*, 51*c*). Accordingly, the cooling performance of the evaporator (51*a*, 51*b*, 51*c*) can be improved.

Referring to a nineteenth example, in the refrigerating apparatus of the eighteenth example, the refrigerant circuit (11) includes a gas injection path (44) that sends the gas refrigerant separated by the oil separator (22) to the suction side of the compressor (32).

In the nineteenth example, the gas refrigerant separated in the oil separator (22) is sent to the compressor (32) through the gas injection path (44). This prevents excessive accumulation of the gas refrigerant in the oil separator (22). Thus, the oil separator (22) can separate two-phase gas/liquid refrigerant easily.

Referring to a twentieth example, the refrigerating apparatus of the nineteenth example further includes a gas flow rate adjustment mechanism (44*a*) that adjusts a flow rate of the gas refrigerant flowing in the gas injection path (44).

In the twentieth example, the gas flow rate adjustment mechanism (44*a*) can adjust the flow rate of the gas refrigerant flowing in the gas injection path (44).

Referring to a twenty-first example, the refrigerating apparatus of the twentieth example further includes an internal heat exchanger (24) that performs heat exchange between the gas refrigerant having passed through the gas flow rate adjustment mechanism (44*a*) in the gas injection path (44) and the refrigerant supplied from the oil separator (22) to the evaporator (51*a*, 51*b*, 51*c*).

In the twenty-first example, the internal heat exchanger (24) performs heat exchange between the gas refrigerant flowing in the gas injection path (44) and the liquid refrigerant supplied from the oil separator (22) to the evaporator (51*a*, 51*b*, 51*c*). Here, the gas refrigerant flowing in the gas injection path (43) is reduced in pressure when passing through the gas flow rate adjustment mechanism (44*a*). Therefore, the temperature of the gas refrigerant is lower than that of the liquid refrigerant supplied to the evaporator (51*a*, 51*b*, 51*c*). Accordingly, the liquid refrigerant dissipates heat to the gas refrigerant to be cooled.

Advantages

In the present invention, the refrigerant flow limiting section (70, 71, 73, 75, 80) limits the flow of the liquid refrigerant in the oil separator (22) to the oil feed path (43). Accordingly, in the present invention, suction of the liquid refrigerant in the oil separator (22) to the compressor (32) through the oil feed path (43) can be avoided, and a sufficient amount of the liquid refrigerant can be supplied from the oil separator (22) to the evaporator (51*a*, 51*b*, 51*c*). This can ensure the cooling performance of the evaporator (51*a*, 51*b*, 51*c*). Further, according to the present invention, the liquid refrigerant can be prevented from being sucked through the oil feed path (43) to and being compressed by the compressor (32). This can prevent damage to the compressor (32) caused by a so-called liquid compression phenomenon (wet vapor suction).

In the second example, when the refrigerant detection section (70, 73, 74, 80) detects entering of the liquid refrigerant from the oil separator (22) into the oil feed path (43), the opening adjustment mechanism (70) reduces the opening of the oil feed path (43). Accordingly, in the present example, detection of inflow of the liquid refrigerant to the oil feed path (43) can be ensured, thereby quickly limiting the flow of the liquid refrigerant in the oil feed path (43).

Particularly, in the third example, in the oil feed path (43), the temperature sensor (73) detects the temperature of the fluid having been reduced in pressure by the pressure reduction mechanism (70). Entering of the liquid refrigerant into the oil feed path (43) is detected based on the temperature of the fluid detected by the temperature sensor (73). Further, in the fourth example, in the oil feed path (43), the temperature sensor (73) detects the temperature of the fluid having been heated by the heating section (74). Entering of the liquid refrigerant into the oil feed path (43) is detected based on the temperature of the fluid detected by the temperature sensor (73). Accordingly, in the third and fourth examples, the second example can be realized by such simple configurations. In addition, these refrigerant detection section (70, 73, 74, 80) are provided at the oil feed path (43) outside the oil separator (22). This can facilitate maintenance and replacement.

Furthermore, in the third example, by providing the pressure reduction mechanism (70) in the oil feed path (43), even if the liquid refrigerant flows into the oil feed path (43), the pressure reduction mechanism (70) can limit the flow of the liquid refrigerant. Accordingly, in the third example, avoidance of suction of a large amount of the liquid refrigerant to the compressor (32) can be ensured.

Moreover, in the fourth example, by providing the heating section (74) at the oil feed path (43), even if the liquid refrigerant flows into the oil feed path (43), the heating section (74) can heat and evaporate the liquid refrigerant. That is, heating the refrigerant by the heating section (74) increases the dryness of the refrigerant, thereby preventing a liquid compression phenomenon in the compressor (32).

In the fifth to seventh examples, the heating heat exchanger (74) heat-exchanges part of the fluid flowing in the oil feed path (43) with other part of fluid in the refrigerant circuit (11). Accordingly, in the examples, the fluid in the oil feed path (43) can be heated without additionally providing a heat source, such as a heater. Particularly, in the fifth example, the refrigerant on the inflow side of the expander (33) is heat-exchanged with the refrigerant in the oil feed path (43). Accordingly, in the fifth example, the refrigerant on the inflow side of the expander (33) can be cooled, thereby increasing the cooling performance of the evaporator (51*a*, 51*b*, 51*c*). Further, in the sixth and seventh examples, the fluid in the oil feed path (43) is heated by utilizing the refrigerant and the oil on the discharge side of the compressor (32). This comparatively increases, in the examples, the heat amount of the fluid in the oil feed path (43) to make the difference in temperature variation of the heated fluid to be remarkable between the liquid refrigerant and the oil. Thus, in the examples, entering of the refrigerant into the oil feed path (43) can be detected accurately.

In the eighth example, entering of the liquid refrigerant from the oil separator (22) into the oil feed path (43) is detected based on the degree of superheat of the refrigerant on the suction side of the compressor (32). Thus, in the present example, entering of the liquid refrigerant into the oil feed path (43) can be detected by utilizing a sensor for superheat degree detection used in the refrigeration cycle of the refrigerant circuit (11). This can achieve advantages of the present invention with no increase in the number of components and costs invited.

Moreover, the degree of superheat of the refrigerant on the suction side of the compressor (32) is comparatively stable in steady operation of the refrigerant circuit (11). Accordingly, the use of the degree of superheat can ensure detection of entering of the liquid refrigerant into the oil feed path (43).

In the ninth example, the opening adjustment mechanism (70) adjusts the opening of the oil feed path (43) according to the amount of the oil in the oil separator (22) detected by the oil amount detection section (71, 80). Accordingly, in the present example, the opening of the oil feed path (43) is reduced when the amount of the oil in the oil separator (22) decreases, thereby avoiding sending the liquid refrigerant to the compressor (32) through the oil feed path (43).

In the tenth example, the opening adjustment mechanism (70) adjusts the opening of the oil feed path (43) according to the level of the oil in the oil separator (22) detected by the oil level detection section (71, 80). Accordingly, in the present example, the opening of the oil feed path (43) is reduced when the oil level decreases, thereby avoiding suction of the liquid refrigerant to the compressor (32) through the oil feed path (43).

Particularly, in the eleventh example, when the oil level becomes lower than the predetermined level, the opening adjustment mechanism (70) closes the oil feed path (43). This can ensure prevention of suction of the liquid refrigerant to the compressor (32) through the oil feed path (43).

In the twelfth example, the on-off vale (70) is temporarily opened every time the predetermined close time Δtc elapses. Accordingly, in the present example, entering of the liquid refrigerant from the oil separator (22) into the oil feed path (43) can be prevented easily by a simple configuration.

Particularly, in the thirteenth example, when the refrigerant detection section (90) detects entering of the liquid refrigerant to the oil feed path (43) in opening of the on-off valve, the on-off valve (70) is closed. Accordingly, in the present example, avoidance of suction of the liquid refrigerant to the compressor (32) in opening of the on-off valve (70) can be ensured with no setting of the open time needed.

According to the fourteenth example, the next close time Δtc of the on-off valve (70) can be corrected based on the open time Δto of the on-off valve (70). Further, in the sixteenth example, the oil discharge flow rate W at opening of the on-off valve (70) is calculated, and the reference oil retention amount Vmax in the oil separator (22) is divided by the discharge flow rate W, thereby calculating the theoretical open time Δtoi necessary for discharging the oil to the oil retention amount Vmax.

Here, in the fifteenth example, when the actually measured open time Δto is shorter than the theoretical open time Δtoi, the close time Δtc of the on-off valve (70) is set longer. Thus, when the oil retention amount tends to be too small in the oil separator (22), much more oil can be retained in closing of the on-off valve (70) after the correction, so that the oil retention amount can approximate Vmax. Consequently, the frequency of opening of the on-off valve (70) can be reduced, thereby further reducing a risk that the oil in the oil separator (22) is sucked to the compressor (32). Further, mechanical degradation of the on-off valve (70) in association with on-off operation of the on-off valve (70) can be suppressed.

Moreover, in the fifteenth example, when the actually measured open time Δto is longer than the theoretical open time Δtoi, the close time Δtc of the on-off valve (70) is set shorter. Thus, when the oil retention amount tends to be excessive in the oil separator (22), the amount of the oil accumulated in closing of the on-off valve (70) can be reduced after the correction, so that the oil retention amount can approximate Vmax. Consequently, a decrease in oil separation rate caused due to excessive accumulation of the oil in the oil separator (22) can be prevented. In addition, outflow of the oil, which has not been separated, toward the evaporator (51*a*, 51*b*, 51*c*) can be prevented.

In the sixteenth example, by utilizing the difference between the pressure acting inside the oil separator (22) and the pressure on the suction side of the compressor (32), the discharge flow rate W of the oil from the oil separator (22) to the oil feed path (43) can be easily and accurately estimated with the use of an existing sensor and the like independent of change in operation condition.

In the seventeenth example, the capillary tube (75) is provided in the oil feed path (43). By this simple configuration, it can be suppressed to send the liquid refrigerant in the oil separator (22) to the suction side of the compressor (32).

In the eighteenth example, the oil separator (22) separates the two-phase gas/liquid refrigerant into the gas refrigerant and the liquid refrigerant, and the liquid refrigerant is supplied to the evaporator (51*a*, 51*b*, 51*c*). Accordingly, in the present example, the cooling performance of the evaporator (51*a*, 51*b*, 51*c*) can be further increased when compared with the case where both the gas refrigerant and the liquid refrigerant are supplied.

In the nineteenth example, the gas refrigerant in the oil separator (22) is sent to the suction side of the compressor (32) through the gas injection path (44). Accordingly, in the present example, it is hard to retain the gas refrigerant in the oil separator (22), thereby increasing the gas/liquid separation rate of the two-phase gas/liquid refrigerant in the oil separator (22). Further, the oil separator (22) is connected to the suction side of the compressor (32) through the gas injection path (44), thereby decreasing the pressure in the oil separator (22). This can increase the difference between the pressure on the inflow side and that on the outflow side (internal pressure of the oil separator) of the expander (33), thereby increasing the power that can be recovered in the expander (33).

In the twentieth example, the gas flow rate adjustment mechanism (44*a*) can adjusts the flow rate of the gas refrigerant in the gas injection path (44). Accordingly, in the present example, the amount of the gas refrigerant sucked to the compressor (32) can be changed freely.

In the twenty-first example, the internal heat exchanger (24) performs heat exchange between the gas refrigerant having passed through the gas flow rate adjustment mechanism (44*a*) in the gas injection path (44) and the liquid refrigerant sent from the oil separator (22) to the evaporator (51*a*, 51*b*, 51*c*). Accordingly, in the present example, the gas refrigerant can cool the liquid refrigerant sent to the evaporator (51*a*, 51*b*, 51*c*). Consequently, the cooling performance of the evaporator (51*a*, 51*b*, 51*c*) can be further increased.

BRIEF DESCRIPTION OF THE DRAWINGS

FIG. 3 illustrates diagrams of a piping system showing the vicinity of the oil separator of the air conditioner according to Example Embodiment 1, in which

FIG. 11 illustrates time charts indicating variations in oil level in the oil separator and on-off state of the on-off valve in the air conditioner according to Example Embodiment 5, in which FIG. 5(A), FIG. 5(B), and FIG. 5(C) show the case where a close time is not corrected, the case where the close time is corrected longer, and where the close time is corrected shorter, respectively.

DESCRIPTION OF CHARACTERS

Figure 1:
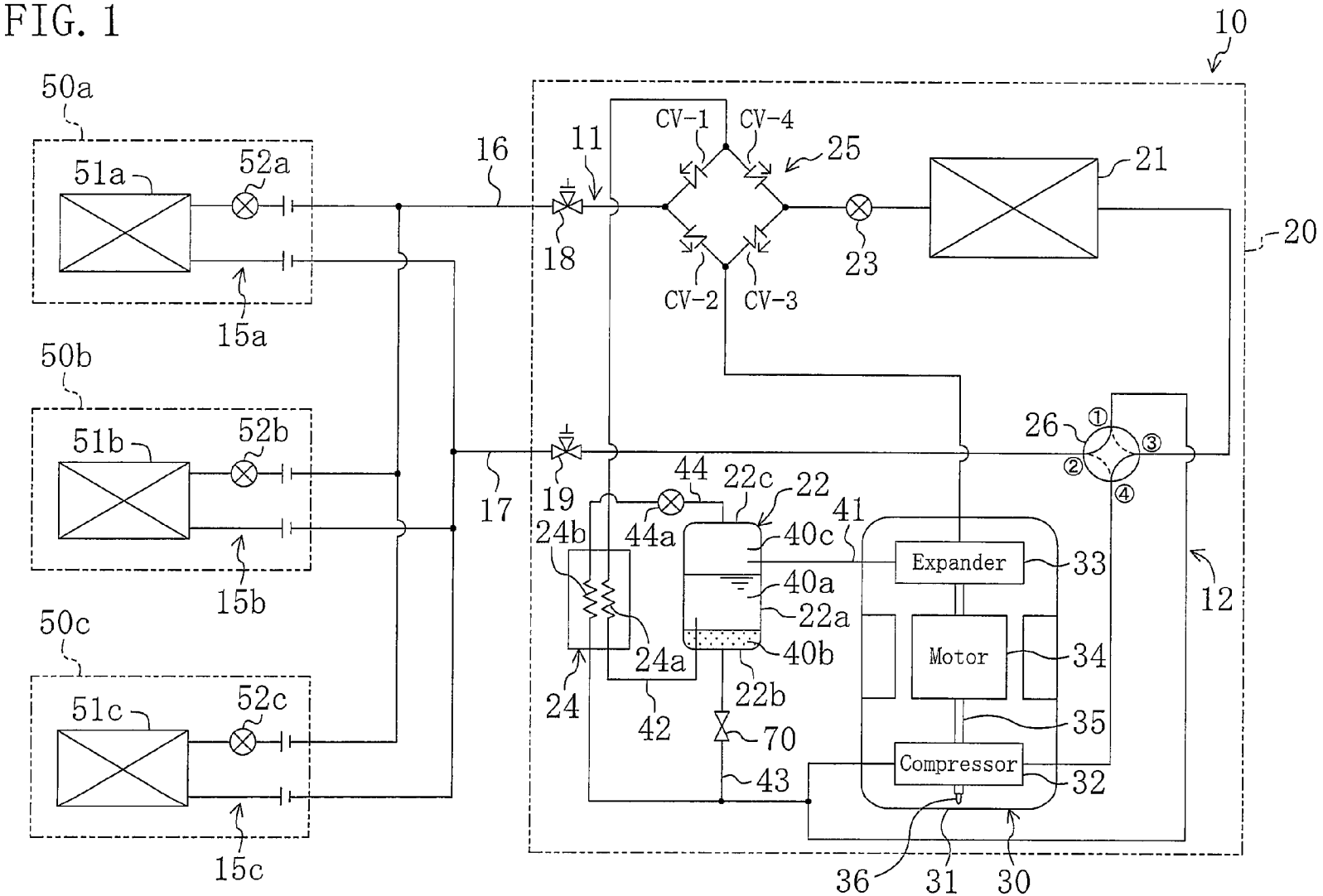
FIG. 1 is a diagram of a piping system showing a schematic configuration of an air conditioner according to Example Embodiment 1.

10 air conditioner (refrigerating apparatus)
11 refrigerant circuit
21 outdoor heat exchanger (radiator)
22 oil separator
24 internal heat exchanger
27 high pressure side oil separator
32 compressor
33 expander
43 oil feed pipe (oil feed path)
44*a* gas injection valve
45 oil return pipe (oil return path)
51*a* indoor heat exchanger (evaporator)
51*b* indoor heat exchanger (evaporator)
51*c* indoor heat exchanger (evaporator)
70 on-off valve (opening adjustment mechanism, pressure reduction mechanism, refrigerant detection section, refrigerant flow limiting section)
71 lower limit float switch (oil level detection section, oil amount detection section, refrigerant flow limiting section)
73 temperature sensor (refrigerant detection section)
74 heating heat exchanger (heating section, refrigerant detection section)
75 capillary tube (refrigerant flow limiting section)
80 control section (oil amount detection section, oil level detection section, refrigerant detection section, refrigerant flow limiting section, valve control section)
82 open time counter (open time measurement section)
83 oil flow rate estimating section (oil flow rate estimating section)
90 superheat degree detection section

BEST MODE FOR CARRYING OUT THE INVENTION

Example embodiments of the present invention will be described in detail below with reference to the accompanying drawings.

Example Embodiment 1

A refrigerating apparatus according to the present invention configures an air conditioner (10) capable of indoor cooling and heating. As shown in FIG. 1, the air conditioner (10) includes one outdoor unit (20) and three indoor units (50*a*, 50*b*, 50*c*). It is noted that the number of the indoor units (50*a*, 50*b*, 50*c*) is a mere example, and is not limited to three.

The air conditioner (10) includes a refrigerant circuit (11). The refrigerant circuit (11) is a closed circuit in which carbon dioxide ($CO_2$) is filled as refrigerant. The refrigerant circuit (11) includes one outdoor circuit (12) and three indoor circuits (15*a*, 15*b*, 15*c*). The indoor circuits (15*a*, 15*b*, 15*c*) are connected in parallel to the outdoor circuit (12) through a first communication pipe (16) and a second communication pipe (17). Specifically, the fist communication pipe (16) has one end connected to a first stop valve (18) of the outdoor circuit (12), and the other end branching into three and connected to liquid side ends of the indoor circuits (15*a*, 15*b*, 15*c*). The second communication pipe (17) has one end connected to a second stop valve (19) of the outdoor circuit (12), and the other end branching into three and connected to gas side ends of the indoor circuits (15*a*, 15*b*, 15*c*).

The indoor circuits (15*a*, 15*b*, 15*c*) are housed one by one in the indoor units (50*a*, 50*b*, 50*c*). In the indoor circuits (15*a*, 15*b*, 15*c*), indoor heat exchangers (51*a*, 51*b*, 51*c*) and indoor expansion valves (52*a*, 52*b*, 52*b*) are provided in this order from the gas side end to the liquid side end. The indoor units (50*a*, 50*b*, 50*c*) include indoor fans (not shown) for sending indoor air to the indoor heat exchangers (51*a*, 51*b*, 51*c*).

The indoor heat exchangers (51*a*, 51*b*, 51*c*) are configured by fin and tube heat exchangers of cross fin type. To the indoor heat exchangers (51*a*, 51*b*, 51*c*), the indoor fans supply indoor air. The indoor heat exchangers (51*a*, 51*b*, 51*c*) perform heat exchange between the indoor air and the refrigerant. Further, the indoor expansion valves (52*a*, 52*b*, 52*c*) are configured by opening variable electronic expansion valves.

The outdoor circuit (12) is housed in the outdoor unit (20). The outdoor circuit (12) includes a compression/expansion unit (30), an outdoor heat exchanger (21), an oil separator (22), an outdoor expansion valve (23), an internal heat exchanger (24), a bridge circuit (20), and a four-way switching valve (26). The outdoor unit (20) includes an outdoor fan (not shown) for sending outdoor air to the outdoor heat exchanger (21).

The compression/expansion unit (30) includes a casing (31) as a vertically long and cylindrical hermetic container. The casing (31) houses a compressor (32), an expander (33), and a motor (34). In the casing (31), the compressor (32), the motor (34), and the expander (33) are disposed in this order from bottom to top, and are connected to one another through a single drive shaft (35).

The compressor (32) and the expander (33) are configured by positive displacement fluid machineries (swing piston type rotary fluid machineries, rolling piston type rotary fluid machineries, scroll fluid machineries, etc.). The compressor (32) compresses the refrigerant ($CO_2$) sucked therein up to its critical pressure or higher. The expander (33) expands the refrigerant ($CO_2$) flowing therein to recover power (expansion power). The compressor (32) is driven and rotated by both the power recovered by the expander (33) and power generated by the motor (34) in a conductive state. Alternating current power at a predetermined frequency is supplied from an inverter (not shown) to the motor (34). The capacity of the compressor (32) is displaced by changing the frequency of the power supplied to the motor (34). The compressor (32) and the expander (33) are rotated at the same rotation speed all the time.

In the bottom of the casing (31), oil (refrigerating machine oil) for lubricating the sliding portions of the compressor (32) and the expander (33) is retained. In the present example embodiment, polyalkylene glycol is used as this oil. However, the refrigerating machine oil may be any other oil as long as it is separable from the refrigerant at least in the temperature range of −20° C. or higher and has a density greater than the refrigerant in this temperature range. Specifically, examples of the oil include polyvinyl ether, polyol ester, polycarbonate, alkylbenzene, and the like.

At the lower end of the drive shaft (35), an oil pump (36) is provided for pumping up the oil retained in the bottom of the casing (31). The oil pump (36) is configured by a centrifugal pump rotating together with the drive shaft (35) and pumping oil up by centrifugal force. The oil pumped up by the oil pump (36) is supplied to the compressor (32) and the expander (33) through the oil path (not shown) in the drive shaft (35). The oil supplied to the compressor (32) and the expander (33) is utilized for lubricating the sliding portions, and then flows out to the refrigerant circuit (11) together with the refrigerant.

The outdoor heat exchanger (21) is configured as a fin and tube heat exchanger of cross fin type. To the outdoor heat exchanger (21), an outdoor fan supplies outdoor air. The outdoor heat exchanger (21) performs heat exchange between the outdoor air and the refrigerant. The outdoor heat exchanger (21) has one end connected to the third port of the four-way switching valve (26), and the other end connected to the bridge circuit (25) via an outdoor expansion valve (23). The outdoor expansion valve (23) is configured by an opening variable electronic expansion valve.

The oil separator (22) separates the oil from the refrigerant in a gas/liquid two-phase state flowing out from the expander (33). The oil separator (22) is a vertically long and cylindrical hermetic container. Specifically, the oil separator (22) is configured in such a fashion that a cylindrical peripheral wall (22*a*), a bottom wall (22*b*) closing the lower end of the peripheral wall (22*a*), and a top wall (22*c*) closing the upper end of the peripheral wall (22*a*) are formed integrally.

To the peripheral wall (22*a*) of the oil separator (22), an inflow pipe (41) is connected. The inflow pipe (41) has one end passing through the peripheral wall (22*a*) in a radial direction and opening in the oil separator (22). The opening at the one end of the inflow pipe (41) faces in the horizontal direction. The opening height of the one end of the inflow pipe (41) is slightly close to the top wall (22*c*) of the oil separator (22). The other end of the inflow pipe (41) is connected to the outflow port of the expander (33).

To the bottom wall (22*b*) of the oil separator (22), an outflow pipe (42) is connected. The outflow pipe (42) has one end passing through the bottom wall (22*b*) in the perpendicular direction and opening in the oil separator (22). The opening at the one end of the outflow pipe (42) faces in the perpendicular direction. The opening height of the one end of the outflow pipe (42) is lower than the one end of the inflow pipe (41). The other end of the outflow pipe (42) is connected to the bridge circuit (25) via the internal heat exchanger (24).

To the bottom wall (22*b*) of the oil separator (22), an oil feed pipe (43) as an oil feed path is also connected. The oil feed pipe (43) has one end opening to the bottom wall (22*b*)

and facing in the oil separator (22). The opening height of the one end of the oil feed pipe (43) is lower than the one end of the outflow pipe (42), and substantially agrees with the inner face (bottom face) of the bottom wall (22*b*). The other end of the oil feed pipe (43) is connected to the suction side of the compressor (32).

To the top wall (22*c*) of the oil separator (22), a gas injection pipe (44) as a gas injection path is connected. The gas injection pipe (44) has one end opening to the top wall (22*c*) and facing in the oil separator (22). The opening height of the one end of the gas injection pipe (44) is higher than the one end of the inflow pipe (41), and substantially agrees with the inner face (top face) of the top wall (22*c*). The other end of the gas injection pipe (44) is connected to the suction side of the compressor (32) via the internal heat exchanger (24). The gas injection pipe (44) includes a gas injection valve (44*a*) as a gas flow rate adjustment mechanism on the inflow side of the internal heat exchanger (24). The gas injection valve (44*a*) is configured by an opening variable electronic expansion valve.

The oil separator (22) is configured to separate the oil from the two-phase gas/liquid refrigerant flowing out from the expander (33) while at the same time separating the two-phase gas/liquid refrigerant into liquid refrigerant and gas refrigerant. Specifically, in the two-phase gas/liquid refrigerant flowing in the oil separator (22), the oil (refrigerating machine oil), the liquid refrigerant, and the gas refrigerant, which are in decreasing order, are mixed. For this reason, in the oil separator (22), the oil having the largest density is retained in the bottom to form an oil pool (40*b*), while the gas refrigerant having the smallest density is retained in the top to form a gas pool (40*c*). Further, in the oil separator (22), the liquid refrigerant is retained between the oil pool (40*b*) and the gas pool (40*c*) to form a liquid pool (40*a*). In principle, the outflow pipe (42) and the oil feed pipe (43) face the liquid pool (40*a*) and the oil pool (40*b*), respectively. Further, the inflow pipe (41) and the gas injection pipe (44) face the gas pool (40*c*).

The internal heat exchanger (24) is provided across the outflow pipe (42) and the gas injection pipe (44). The internal heat exchanger (24) includes a heat dissipation section (24*a*) formed in the middle of the outflow pipe (42), and a heat absorption section (24*b*) formed in the middle of the gas injection pipe (44). The internal heat exchanger (24) performs heat exchange between the liquid refrigerant flowing in the heat dissipation section (24*a*) and the gas refrigerant flowing in the heat absorption section (24*b*).

The bridge circuit (25) is formed by connecting four check valves (CV-1 to CV-4) in a bridge like form. The inflow sides of the first check valve (CV-1) and the fourth check valve (CV-4) of the bridge circuit (25) are connected to the outflow pipe (42). The outflow sides of the second check valve (CV-2) and the third check valve (CV-3) are connected to the inflow side of the expander (33). The outflow side of the first check valve (CV-1) and the inflow side of the second check valve (CV-2) are connected to the first stop valve (18). The inflow side of the third check valve (CV-3) and the outflow side of the fourth check valve (CV-4) are connected to the outdoor expansion valve (23). The check valves (CV-1, CV-2, CV-3, CV-4) allow only the refrigerant flow indicated by the arrows in FIG. 1 and restrict the refrigerant flow in the reverse direction thereto.

The first port of the four-way switching valve (26) is connected to the suction side of the compressor (32). The second port is connected to the second stop valve (19). The third port is connected to the outdoor heat exchanger (21). The fourth port is connected to the discharge side of the compressor (32). The four-way switching valve (26) is switched between the state where the first port communicates with the second port while the third port communicates with the fourth port (a first state indicted by the solid lines in FIG. 1) and the state where the first port communicates with the third port while the second port communicates with the fourth port (a second state indicted by the broken lines in FIG. 1).

Figure 2:
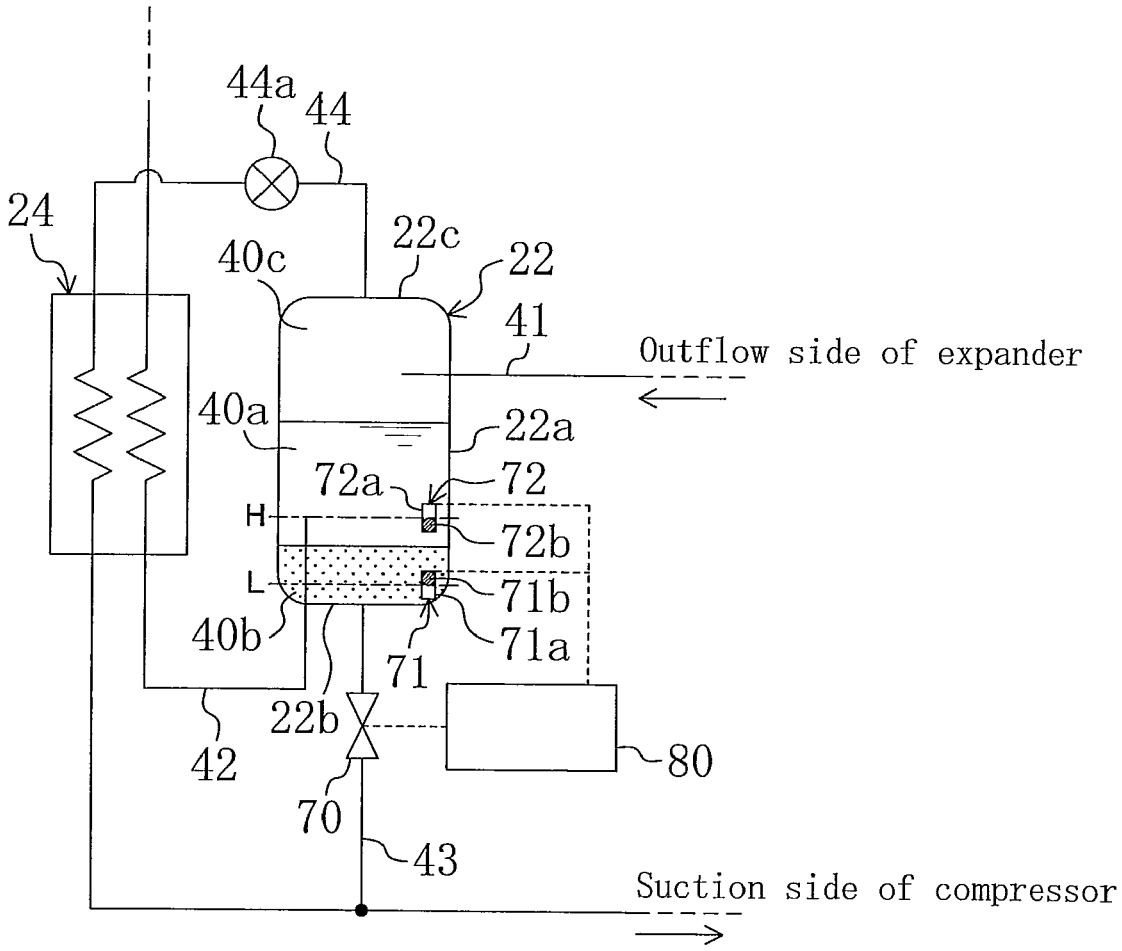
FIG. 2 is a diagram of a piping system showing the vicinity of an oil separator of the air conditioner according to Example Embodiment 1.

As shown in FIG. 2, the air conditioner (10) of the present example embodiment includes an on-off valve (70), two float switches (71, 72), and a control section (80). The on-off valve (70) is provided in the oil feed pipe (43). The on-off valve (70) serves as an opening adjustment mechanism for adjusting the opening of the oil feed pipe (43). Specifically, the on-off valve (70) is configured by a closable solenoid valve. That is, the on-off valve (70) is switched between the state where the oil feed pipe (43) is opened and the state where it is closed. Further, the channel area of the on-off valve (70) in the opened state is smaller than that of the oil feed pipe (43) so as to throttle the fluid flowing therethrough for providing resistance to the fluid. In other words, the on-off valve (70) also serves as a pressure reduction mechanism for reducing the pressure of the fluid flowing in the oil feed pipe (43).

The two float switches (71, 72) are provided inside the oil separator (22). The float switches (71, 72) serve as an oil level detection section that detects the level of the oil in the oil separator (22), and in turn serve as an oil amount detection section that detects the amount of the oil in the oil separator (22). Specifically, in the oil separator (22), a lower limit float switch (71) is disposed near the bottom wall (22*b*), and the upper limit float switch (72) is disposed above the lower limit float switch (71). The float switches (71, 72) include vertically long and cylindrical guide portions (71*a*, 72*a*) and spherical float portions (71*b*, 72*b*) held inside the guide portions (71*a*, 72*a*). Inside the guide portions (71*a*, 72*a*), the float portions (71*b*, 72*b*) are held so as to be capable of shifting in the perpendicular direction. The density of the float portions (71*b*, 72*b*) is smaller than that of the oil in the oil separator (22) and larger than that of the liquid refrigerant. That is, the float portions (71*b*, 72*b*) float on the oil and do not float on the liquid refrigerant in the oil separator (22).

The lower limit float switch (71) detects whether the level of the oil in the oil separator (22) is lower than a lower limit level L or not. The lower limit level L is set at a level slightly higher than the bottom face of the oil separator (22). The upper limit float switch (72) detects whether the level of the oil in the oil separator (22) is higher than an upper limit level H or not. The upper limit level H is set at a level higher than the lower limit level L and is equal to or lower than the opening height of the outflow pipe (42). In the present example embodiment, the upper limit level H almost agrees with the opening height of the outflow pipe (42).

The control section (80) receives detection signals of the lower limit float switch (71) and the upper limit float switch (72), and performs on-off control on the on-off valve (70) according to the detection signals. The on-off valve (70), the lower limit float switch (71), and the control section (80) configure a refrigerant flow limiting section that limits the flow of the fluid flowing in the oil feed pipe (43) for the purpose of preventing the liquid refrigerant in the oil separator (22) from being sucked to the compressor (32) through the oil feed pipe (43). Further, the on-off valve (70), the upper limit float switch (72), and the control section (80) configure an oil flow limiting section that limits inflow of the oil in the oil separator (22) to the outflow pipe (42). The on-off control on the oil feed pipe (43) by the control section (80) will be described later.

—Operation Modes—

Operation modes of the air conditioner (10) will now be described. The air conditioner (10) is capable of performing cooling operation for indoor cooling and heating operation for indoor heating.

<Heating Operation>

During the heating operation, the four-way switching valve (26) is set in the state indicated by the broken lines in FIG. 1. During the heating operation, the openings of the indoor expansion valves (52*a*, 52*b*, 52*c*) are adjusted independently, and the opening of the outdoor expansion valve (23) is also adjusted appropriately. Further, the on-off valve (70) in the oil feed pipe (43) is opened in principal, and the opening of the gas injection valve (44*a*) is adjusted appropriately. When the motor (34) is energized in this state, the compressor (32) is driven to circulate the refrigerant in the refrigerant circuit (11). Consequently, during the heating operation, the refrigeration cycle is performed in which the indoor heat exchangers (51*a*, 51*b*, 51*c*) function as radiators, and the outdoor heat exchanger (21) functions as an evaporator.

Specifically, the compressor (32) discharges the refrigerant whose pressure is higher than the critical pressure. This high pressure refrigerant is distributed to the indoor circuits (15*a*, 15*b*, 15*c*) via the second communication pipe (17). The refrigerant flowing in the indoor circuits (15*a*, 15*b*, 15*c*) flows into the indoor heat exchangers (51*a*, 51*b*, 51*c*). In the indoor heat exchangers (51*a*, 51*b*, 51*c*), the refrigerant dissipates heat to indoor air, thereby performing indoor heating. In the indoor circuits (15*a*, 15*b*, 15*c*), the heating capacities of the indoor heat exchangers (51*a*, 51*b*, 51*c*) are adjusted independently according to the openings of the indoor expansion valves (52*a*, 52*b*, 52*c*). The refrigerant having dissipated heat in the indoor heat exchangers (51*a*, 51*b*, 51*c*) is merged in the first communication pipe (16), and flows into the outdoor circuit (12).

The expander (33) reduces the pressure of the refrigerant flowing in the outdoor circuit (12) up to the intermediate pressure. At this time, the expansion power of the expander (33) is recovered as the rotational force of the drive shaft (35). The refrigerant whose pressure has been reduced in the expander (33) flows in a gas/liquid two-phase sate through the inflow pipe (41) into the oil separator (22). At this time, the oil utilized for lubricating the sliding portions of the expander (33) also flows into the oil separator (22).

In the oil separator (22), the two-phase gas/liquid refrigerant containing the oil turns along the inner peripheral face of the peripheral wall (22*a*). This separates the oil from the refrigerant and separates the two-phase gas/liquid refrigerant into the liquid refrigerant and the gas refrigerant. Consequently, the oil, the liquid refrigerant, and the gas refrigerant are retained in the oil pool (40*b*), the liquid pool (40*a*), and the gas pool (40*c*), respectively.

The liquid refrigerant in the liquid pool (40*a*) of the oil separator (22) flows out to the outflow pipe (42), and then flows into the internal heat exchanger (24). On the other hand, the gas refrigerant in the gas pool (40*c*) of the oil separator (22) flows out to the gas injection pipe (44). The gas refrigerant is reduced in pressure when passing through the gas injection valve (44*a*), and then flows into the internal heat exchanger (24). In the internal heat exchanger (24), heat exchange is performed between the liquid refrigerant flowing in the heat dissipation section (24*a*) and the gas refrigerant flowing in the heat absorption section (24*b*). Consequently, the liquid refrigerant in the heat dissipation section (24*a*) provides heat to the gas refrigerant in the heat absorption section (24*b*) to be subcooled. The subcooled liquid refrigerant is reduced in pressure up to the low pressure when passing through the outdoor expansion valve (23), and then flows into the outdoor heat exchanger (21). In the outdoor heat exchanger (21), the refrigerant absorbs heat from outdoor air to be evaporated. The refrigerant evaporated in the outdoor heat exchanger (21) is mixed with the gas refrigerant flowing out from the gas injection pipe (44), and then is sucked into the compressor (32).

On the other hand, the oil retained in the oil pool (40*b*) of the oil separator (22) flows into the oil feed pipe (43). The oil is reduced in pressure up to the low pressure when passing through the on-off valve (70) in the opened state, and then is sucked into the compressor (32). The oil sucked in the compressor (32) is utilized for lubricating the sliding portions of the compressor (32) and the expander (33).

<Cooling Operation>

During the cooling operation, the four-way switching valve (26) is set in the state indicated by the solid lines in FIG. 1. During the cooling operation, the openings of the indoor expansion valves (52*a*, 52*b*, 52*c*) are adjusted independently, and the outdoor expansion valve (23) is opened fully. Further, the on-off valve (70) in the oil feed pipe (43) is opened in principle, and the opening of the gas injection valve (44*a*) is adjusted appropriately. When the motor (34) is energized in this state, the compressor (32) is driven to circulate the refrigerant in the refrigerant circuit (11). Consequently, during the cooling operation, the refrigeration cycle is performed in which the indoor heat exchangers (51*a*, 51*b*, 51*c*) function as evaporators, and the outdoor heat exchanger (21) functions as a radiator.

Specifically, the compressor (32) discharges the refrigerant whose pressure is higher than the critical pressure. This high pressure refrigerant dissipates heat in the outdoor heat exchanger (21), is reduced in pressure up to the intermediate pressure in the expander (33), and then flows into the oil separator (22). The oil separator (22) separates the two-phase gas/liquid refrigerant containing the oil into the oil, the liquid refrigerant, and the gas refrigerant.

The refrigerant flowing out from the oil separator (22) to the outflow pipe (42) flows into the heat dissipation section (24*a*) of the internal heat exchanger (24). On the other hand, the refrigerant flowing out from the oil separator (22) to the gas injection pipe (44) is reduced in pressure through the gas injection valve (44*a*), and then flows into the heat absorption section (24*b*) of the internal heat exchanger (24). In the internal heat exchanger (24), the liquid refrigerant in the heat dissipation section (24*a*) dissipates heat to the gas refrigerant in the heat absorption section (24*b*) to be subcooled. The liquid refrigerant having been subcooled is distributed to the indoor circuits (15*a*, 15*b*, 15*c*) via the first communication pipe (16).

Here, subcooling the liquid refrigerant by the internal heat exchanger (24) can suppress change in state of the liquid refrigerant to the two-phase gas/liquid refrigerant in the refrigerant paths from the first communication pipe (16) to the indoor expansion valves (52*a*, 52*b*, 53). Specifically, where the pressure loss in such a refrigerant path is comparatively large, the liquid refrigerant is reduced in pressure to tend to be in the gas/liquid two-phase state. However, when the refrigerant is sufficiently subcooled liquid refrigerant, even pressure reduction can hardly change the state of the refrigerant to the gas/liquid two-phase state. Thus, where the state of the liquid refrigerant is changed to the gas/liquid two-phase state, for example, the liquid refrigerant supplied to the indoor units (50*a*, 50*b*, 50*c*) may flow locally. However, the liquid refrigerant can be supplied equally to the indoor units (50*a*, 50*b*, 50*c*) in the present example embodiment.

The liquid refrigerant supplied to the indoor circuits (15*a*, 15*b*, 15*c*) is reduced in pressure when passing through the indoor expansion valves (52*a*, 52*b*, 52*c*). Since the refrigerant passing through the indoor expansion valves (52*a*, 52*b*, 52*c*) at this time is in a single liquid phase state, the noise of the refrigerant passing through the indoor expansion valves (52*a*, 52*b*, 52*c*) is smaller than that in the case where the refrigerant is in the gas/liquid two-phase state. The refrigerant whose pressure is reduced up to the low pressure in the indoor expansion valves (52*a*, 52*b*, 52*c*) flows into the indoor heat exchangers (51*a*, 51*b*, 51*c*). In the indoor heat exchangers (51*a*, 51*b*, 51*c*), the refrigerant absorbs heat from indoor air to be evaporate. Consequently, the indoor air is cooled, thereby performing indoor cooling. The refrigerant evaporated in the indoor heat exchangers (51*a*, 51*b*, 51*c*) is mixed with the gas refrigerant flowing out from the gas injection pipe (44), and then is sucked into the compressor (32).

On the other hand, the oil retained in the oil pool (40*b*) of the oil separator (22) flows into the oil feed pipe (43). This oil is reduced in pressure up to the low pressure when passing through the on-off valve (70) in the opened state, and then is sucked into the compressor (32). The oil sucked in the compressor (32) is utilized for lubricating the sliding portions of the compressor (32) and the expander (33).

—Opening Control on Oil Feed Pipe—

As described above, during the heating operation and the cooling operation of the air conditioner (10), the oil retained in the bottom of the oil separator (22) is sent to the suction side of the compressor (32). Incidentally, the amount of the oil retained in the oil separator (22) varies depending on various driving conditions, such as the output frequency of the compression/expansion unit (30), for example. When the oil level becomes too low in association with such variation in the amount of oil in the oil separator (22), the liquid refrigerant in the oil separator (22) may be sent to the suction side of the compressor (32) through the oil feed pipe (43). Consequently, in the cooling operation, for example, the amount of the liquid refrigerant supplied to the indoor heat exchangers (51*a*, 51*b*, 51*c*) functioning as evaporators may decrease to reduce the cooling capacities of the indoor units (50*a*, 50*b*, 50*c*). Further, suction of the liquid refrigerant to the compressor (32) may cause a so-called liquid compression (wet vapor suction) phenomenon to damage the compressor (32).

On the other hand, when the level of the oil in the oil separator (22) becomes too high, the oil in the oil separator (22) may flow into the outflow pipe (42). Consequently, in the cooling operation, for example, the oil may adhere to the heat transfer tubes of the indoor heat exchangers (51*a*, 51*b*, 51*c*) functioning as evaporators to reduce the heat transfer performance of the indoor heat exchangers (51*a*, 51*b*, 51*c*). Therefore, the cooling capacities of the indoor heat exchangers (51*a*, 51*b*, 51*c*) may decrease also in such a case. In view of this, in the air conditioner (10) of the present example embodiment, the opening control on the oil feed pipe (43) is performed for addressing such disadvantages.

Figure 3B:
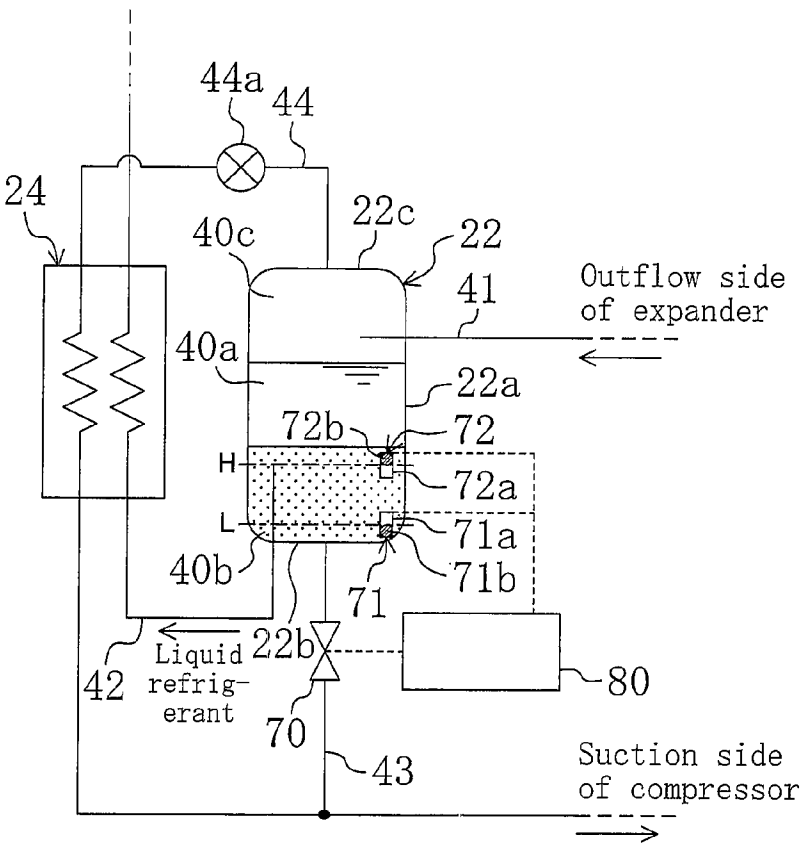
FIG. 3(B) shows the state where the oil level is high.
Figure 3A:
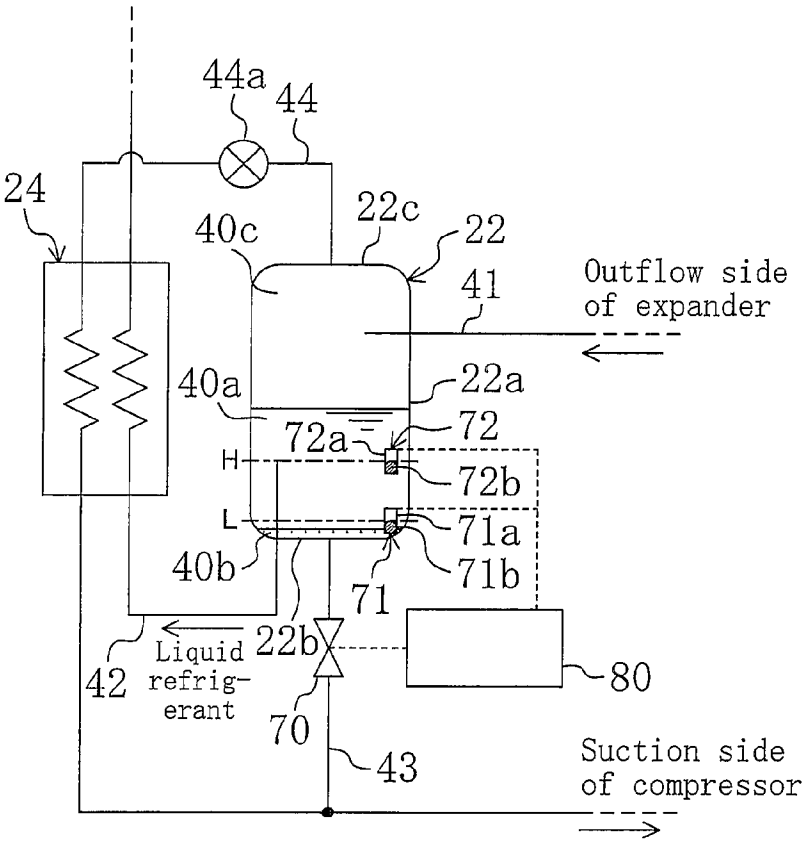
FIG. 3(A) shows the state where the oil level is low.

As shown in FIG. 3(A), assume that the level of the oil in the oil separator (22) becomes lower than the lower limit level L in, for example, the cooling operation. In this case, the float portion (71*b*) of the lower limit float switch (71) shifts below the lower limit level L together with the oil level. Accordingly, the lower limit float switch (71) outputs a detection signal to the control section (80). Upon receipt of the detection signal, the control section (80) closes the on-off valve (70). Consequently, even in the state where the level of the oil in the oil separator (22) is too low, the on-off valve (70) in the closed state prevents the liquid refrigerant from being sent to the compressor (32) through the oil feed pipe (43).

When the cooling operation continues in this state, the level of the oil in the oil separator (22) gradually rises. Here, even when the oil level becomes higher than the lower limit level L after the on-off valve (70) is closed, the closing state of the on-off valve (70) is maintained. Assume that the oil level further rises from this state, and exceeds the upper limit level H, as shown in FIG. 3(B). In this case, the float portion (72*b*) of the upper limit float switch (72) shifts above the upper limit level H together with the oil level. Accordingly, the upper limit float switch (72) outputs a detection signal to the control section (80). Upon receipt of the detection signal, the control section (80) opens the on-off valve (70). Consequently, the oil in the oil separator (22) is sent to the compressor (32) through the oil feed pipe (43), thereby reducing the oil level again. Thus, inflow of the oil to the outflow pipe (42) can be prevented. Therefore, only the liquid refrigerant is supplied to the indoor heat exchangers (51*a*, 51*b*, 51*c*).

Advantages of Example Embodiment 1

In Example Embodiment 1, the refrigerant flow limiting section limits the flow of the liquid refrigerant in the oil separator (22) to the oil feed pipe (43). Specifically, in Example Embodiment 1, when the level of the oil in the oil separator (22) becomes lower than the predetermined lower limit level L, the on-off valve (70) is closed. Accordingly, in Example Embodiment 1, in the state where the level of the oil in the oil separator (22) becomes low to cause the liquid refrigerant to tend to flow into the oil feed pipe (43), inflow of the liquid refrigerant to the oil feed pipe (43) can be quickly avoided. This prevents the liquid refrigerant from being sucked to the compressor (32) through the oil feed pipe (43). Thus, a sufficient amount of the liquid refrigerant can be supplied from the oil separator (22) to the indoor heat exchangers (51*a*, 51*b*, 51*c*) in, for example, the cooling operation. This can sufficiently ensure the cooling capacities of the indoor heat exchangers (51*a*, 51*b*, 51*c*). Further, avoidance of suction of the liquid refrigerant to the compressor (32) can prevent damage to the compressor (32) which may be caused by a so-called liquid compression phenomenon (wet vapor suction phenomenon).

Moreover, in Example Embodiment 1, when the level of the oil in the oil separator (22) becomes higher than the predetermined upper limit level H, the on-off valve (70) is opened. That is, in Example Embodiment 1, in the state where the level of the oil in the oil separator (22) becomes high to cause the oil after separation to tend to flow into the outflow pipe (42), the oil is allowed to flow into the oil feed pipe (43). Accordingly, in Example Embodiment 1, the level of the oil in the oil separator (22) can be decreased quickly from such a state, thereby preventing the oil after separation from flowing into the outflow pipe (42). Consequently, the oil after separation can be prevented from adhering to the heat transfer tubes of the indoor heat exchangers (51*a*, 51*b*, 51*c*) in, for example, the cooling operation, thereby preventing a decrease in heat transfer performance of the indoor heat exchangers (51*a*, 51*b*, 51*c*) which may be caused by such oil adhesion.

Furthermore, in Example Embodiment 1, the two-phase gas/liquid refrigerant is separated into the gas refrigerant and the liquid refrigerant in the oil separator (22), and the single liquid phase refrigerant after separation is supplied to the indoor heat exchangers (51*a*, 51*b*, 51*c*) in the cooling operation. This can increase the cooling capacities of the indoor heat exchangers (51*a*, 51*b*, 51*c*).

Here, since the gas refrigerant after separation is sent to the suction side of the compressor (32) through the gas injection pipe (44), the gas refrigerant cannot be excessively retained in the oil separator (22). This can sufficiently ensure the gas/liquid separation capacity of the oil separator (22). Further, connection of the oil separator (22) to the gas injection pipe (44) can decrease the pressure in the oil separator (22). Consequently, the difference between the pressure on the inflow side and that on the outflow side (internal pressure of the oil separator) of the expander (33) increases, thereby increasing power that the expander (33) can recover. Further, the gas injection valve (44*a*) is provided in the gas injection pipe (44). This can achieve adjustment of the amount of the gas refrigerant sucked to the compressor (32) according to the opening of the gas injection valve (44*a*).

In addition, the internal heat exchanger (24) performs heat exchange between the gas refrigerant having passed through the gas injection valve (44*a*) in the gas injection pipe (44) and the liquid refrigerant flowing in the outflow pipe (42). Thus, the refrigerant to be sent to the indoor heat exchangers (51*a*, 51*b*, 51*c*) in the cooling operation can be subcooled, thereby further increasing the cooling capacities of the indoor heat exchangers (51*a*, 51*b*, 51*c*).

Modified Example of Example Embodiment 1

The refrigerating apparatus of Example Embodiment 1 may have the following configurations.

In Example Embodiment 1, the float switches (71, 72) detect the levels of the oil in the oil separator (22). However, other oil level detection sections may detect the upper limit level H and the lower limit level L. The oil level detection section may be a section of high frequency pulse type, supersonic wave type, microwave type, and the like.

Furthermore, the amount of the oil in the oil separator (22) may be directly or indirectly detected for on-off control on the on-off valve (70) according to the detected oil amount. Specifically, the amount of the oil in the oil separator (22) can be obtained, for example, in such a manner that the amount of oil leakage in the casing (31) of the compression/expansion unit (30) is estimated based on the output frequency of the compression/expansion unit (30) (i.e., the number of rotations of the drive shaft), and the oil leakage amount (i.e., the amount of the oil flowing out from the expander (33)) is integrated. Alternatively, measuring the weight of the oil separator (22), for example, can obtain the amount of the oil in the oil separator (22).

Example Embodiment 2

Figure 4:
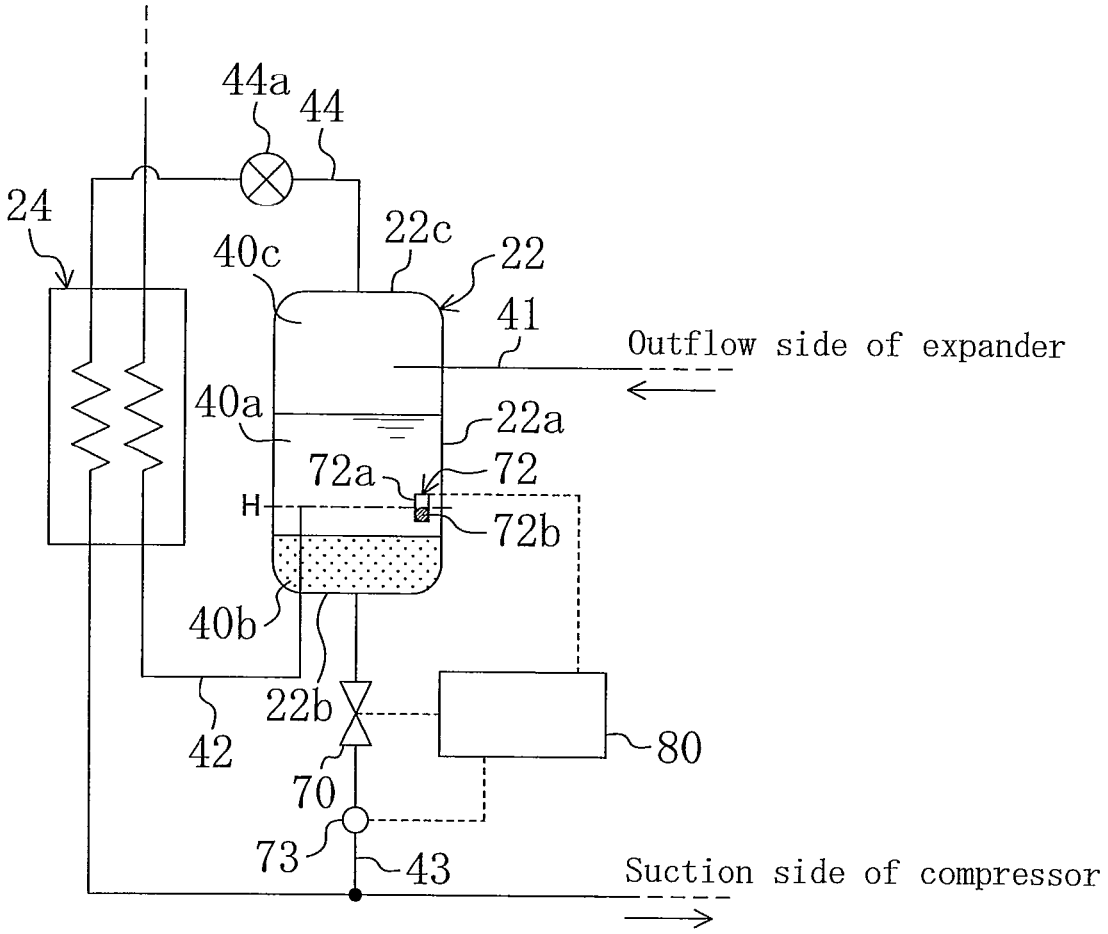
FIG. 4 is a diagram of a piping system showing the vicinity of an oil separator of an air conditioner according to Example Embodiment 2.
Figure 5:
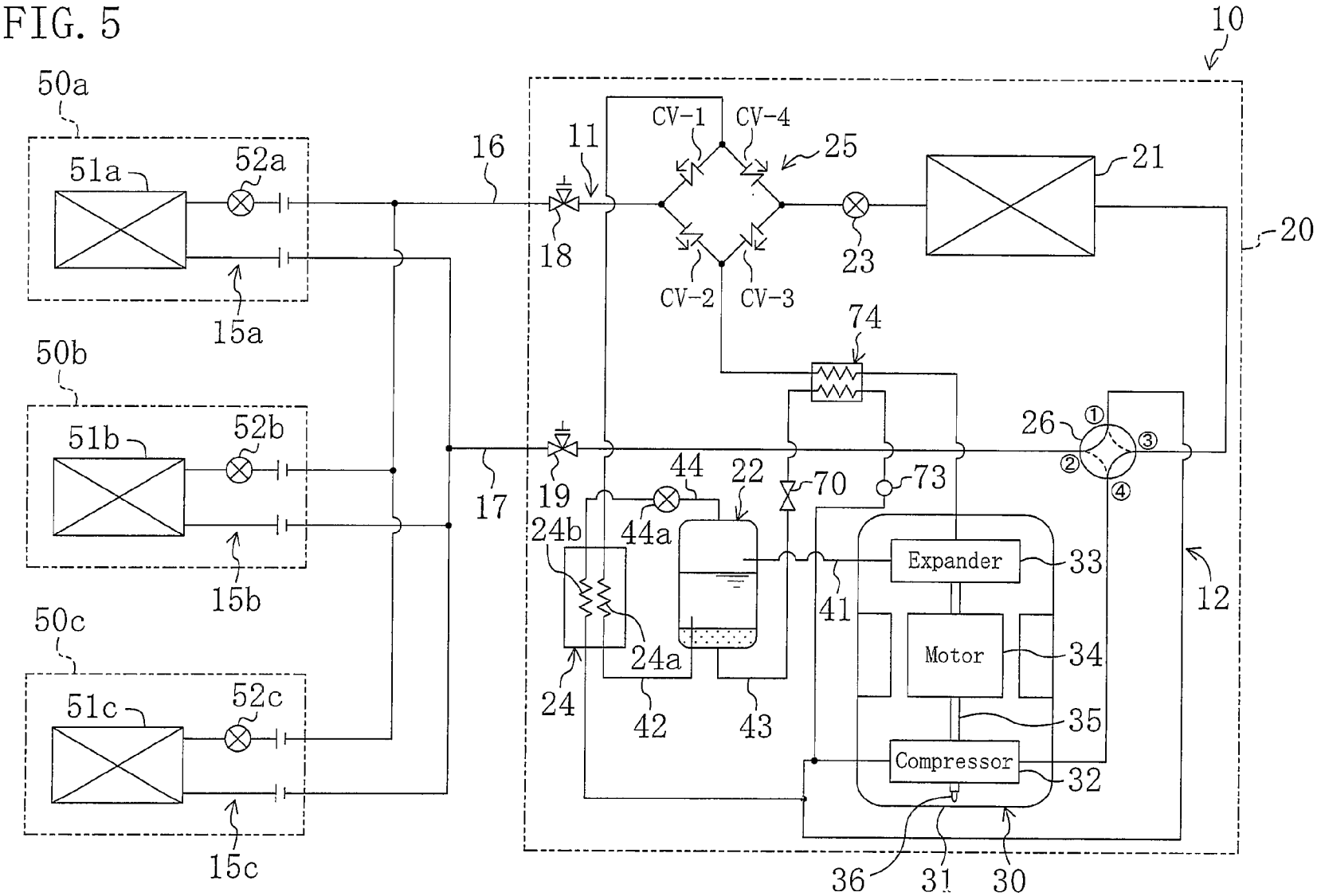
FIG. 5 is a diagram of a piping system showing a schematic configuration of an air conditioner according to Example Embodiment 3.

An air conditioner (10) according to Example Embodiment 2 is different in configuration of a refrigerant flow limiting section from Example Embodiment 1. Specifically, as shown in FIG. 4, the refrigerant flow limiting section includes an on-off valve (70), a temperature sensor (73), and a control section (80) as an on-off control section. Further, an oil separator (22) in Example Embodiment 2 includes the upper limit float switch (72) in Example Embodiment 1, and does not include the lower limit float switch (71) in Example Embodiment 1.

The on-off valve (70) is configured to provide predetermined resistance to the fluid passing therethrough in its opened state, similarly to that in Example Embodiment 1. That is, the on-off valve (70) serves also as a pressure reduction mechanism that reduces the pressure of the fluid flowing therethrough. The temperature sensor (73) is provided on the downstream side of the on-off valve (70) in the oil feed pipe (43). The temperature sensor (73) detects the temperature on the downstream side of the on-off valve (70). The temperature detected by the temperature sensor (73) is output to the control section (80).

The control section (80) calculates the amount of a decrease in the temperature detected by the temperature sensor (73) in a predetermined time period (e.g., five seconds). When the amount ΔT of a decrease in the detected temperature becomes larger than a specified amount, it is determined that the refrigerant enters the oil feed pipe (43). Thus, the on-off valve (70), the temperature sensor (73), and the control section (80) configure the refrigerant detection section that detects entering of the refrigerant from the oil separator (22) to the oil feed pipe (43).

—On-off Control on Oil Feed Pipe—

At the beginning of the operation of the air conditioner (10) in Example Embodiment 2, the on-off valve (70) in the oil feed pipe (43) is in the opened state. Accordingly, the oil in the oil separator (22) flows into the oil feed pipe (43) and passes through the on-off valve (70). At this time, the on-off valve (70) reduces the pressure of the oil. Here, the reduction in oil pressure by the on-off valve (70) hardly reduces the temperature of the oil. For this reason, the temperature of the fluid detected by the temperature sensor (73) remains comparatively high.

From this state, when the amount of the oil in the oil separator (22) decreases, the liquid refrigerant enters the oil feed pipe (43). When this liquid refrigerant is reduced in pressure when passing through the on-off valve (70), the temperature of the liquid refrigerant decreases dramatically. Accordingly, the temperature of the fluid detected by the temperature sensor (73) also decreases dramatically. Therefore, in a transition of the state where the oil flows in the oil feed pipe (43) to the state where the liquid refrigerant flows therein, the detected temperature output to the control section (80) significantly decreases. When the amount of a decrease in detected temperature becomes larger than the specified amount in the control section (80), it is determined that the liquid refrigerant enters from the oil separator (22) to the oil feed pipe (43). This makes the control section (80) to close the on-off valve (70). Thus, the on-off valve (70) prevents the liquid refrigerant from flowing into the oil feed pipe (43).

Continuation of the operation in this state gradually raises the level of the oil in the oil separator (22). When the oil level exceeds the upper limit level H, the upper limit float switch (72) is operated to cause the on-off valve (70) to be opened, similarly to the case in Example Embodiment 1. Accordingly, the oil in the oil separator (22) is sent to the compressor (32) through the oil feed pipe (43) to allow the oil level to decrease again. Thus, inflow of the oil to the outflow pipe (42) can be avoided. Therefore, only the liquid refrigerant is supplied to the indoor heat exchangers (51*a*, 51*b*, 51*c*).

Advantages of Example Embodiment 2

In Example Embodiment 2, the temperature of the fluid after pressure reduction is detected in the oil feed pipe (43), and entering of the liquid refrigerant to the oil feed pipe (43) is detected based on the amount of a decrease in the temperature. When it is determined that the liquid refrigerant enters the oil feed pipe (43), the on-off valve (70) is closed quickly. Accordingly, also in the present example embodiment, the liquid refrigerant can be sufficiently supplied to the indoor heat exchangers (51*a*, 51*b*, 51*c*) in the cooling operation, thereby ensuring the cooling capacities of the indoor heat exchangers (51*a*, 51*b*, 51*c*).

Furthermore, in Example Embodiment 2, the temperature sensor (73) is provided at the oil feed pipe (43). This can facilitate replacement and maintenance of the sensor when compared with the case where the sensor is provided, for example, within the oil separator (22). Further, the on-off valve (70) in the opened state is configured to provide the predetermined resistance to the fluid flowing therethrough. Accordingly, even if the liquid refrigerant in the oil separator (22) flows into the oil feed pipe (43), not so large amount of the liquid refrigerant is sent to the suction side of the compressor (32). In addition, the on-off valve (70) serving also as the pressure reduction mechanism for reducing the pressure of the fluid can eliminate the need to separately provide a pressure reduction mechanism, such as an expansion valve. Thus, the number of components can be reduced.

Modified Example of Example Embodiment 2

The refrigerating apparatus of Example Embodiment 2 may have the following configurations.

In Example Embodiment 2, entering of the liquid refrigerant to the oil feed pipe (43) is detected based on the amount of a decrease in temperature of the fluid detected on the downstream side of the on-off valve (70). However, both the temperatures of the fluid on the upstream side and the downstream side of the on-off valve (70) may be detected by temperature sensors or the like for detecting entering of the liquid refrigerant to the oil feed pipe (43) according to a difference between the temperatures. Specifically, during the time when, for example, the oil flows in the oil feed pipe (43), the temperature of the oil hardly varies on the upstream side and the downstream side of the on-off valve (70). On the other hand, when the liquid refrigerant enters the oil feed pipe (43), the temperature of the liquid refrigerant on the downstream side of the on-off valve (70) is lower than that on the upstream side of the on-off valve (70). In view of this, the temperatures of the refrigerant before inflow into and after outflow from the on-off valve (70) are detected. When the temperature difference becomes larger than a specified amount, it is determined that the liquid refrigerant enters the oil feed pipe (43). Then, the on-off valve (70) is closed. Thus, the flow of the liquid refrigerant in the oil feed pipe (43) can be prevented quickly. It is noted that, for detecting the temperature of the fluid on the upstream side of the on-off valve (70), a temperature sensor may be provided on the upstream side of the on-off valve (70). Alternatively, the temperature may be detected by any other methods. Specifically, a pressure sensor is provided on the outflow side or the like of the expander (33), and the equivalent saturation temperature of the pressure detected by the pressure sensor is used as the temperature of the fluid on the upstream side of the on-off valve (70), for example.

Example Embodiment 3

An air conditioner (10) according to Example Embodiment 3 is the air conditioner (10) of Example Embodiment 2 in which a heating heat exchanger (74) as a heating section is additionally provided at the oil feed pipe (43). The heating heat exchanger (74) in this example is disposed across the oil feed pipe (43) and a pipe on the inflow side of the expander (33). The heating heat exchanger (74) performs heat exchange between the fluid flowing in the oil feed pipe (43) and the refrigerant on the inflow side of the expander (33). Further, in the oil feed pipe (43), an on-off valve (70) is provide on the upstream side of the heating heat exchanger (74), and a temperature sensor (73) is provided on the downstream side of the on-off valve (70). Thus, the on-off valve (70), the temperature sensor (73), the heating heat exchanger (74), and the control section (80) configure a refrigerant detection section that detects entering of the refrigerant from the oil separator (22) to the oil feed pipe (43).

—On-off Control on Oil Feed Path—

At the beginning of the operation of the air conditioner (10) in Example Embodiment 3, the on-off valve (70) in the oil feed pipe (43) is in the opened state. Accordingly, the oil in the oil separator (22) flows into the oil feed pipe (43) and passes through the on-off valve (70). At this time, the on-off valve (70) reduces the pressure of the oil. Here, the reduction in oil pressure by the on-off valve (70) hardly reduces the temperature of the oil. Thereafter, the oil flows into the heating heat exchanger (74). In the heating heat exchanger (74), the refrigerant flowing on the inflow side of the expander (33) dissipates heat to the oil flowing in the oil feed pipe (43). This heats the oil flowing in the oil feed pipe (43). Thus, the temperature of the fluid detected by the temperature sensor (73) is comparative high.

From this state, when the amount of the oil in the oil separator (22) decreases, the liquid refrigerant enters the oil feed pipe (43). When this liquid refrigerant is reduced in pressure when passing through the on-off valve (70), the temperature of the liquid refrigerant decreases dramatically. Thereafter, the liquid refrigerant flows into the heating heat exchanger (74). In the heating heat exchanger (74), the refrigerant flowing on the inflow side of the expander (33) heats the liquid refrigerant flowing in the oil feed pipe (43). Accordingly, in the heating heat exchanger (74), the liquid refrigerant takes the latent heat to be evaporated, but the temperature of the liquid refrigerant does not increase. Therefore, the temperature of the fluid detected by the temperature sensor (73) is comparatively low. As discussed above, the temperature of the oil having passed through the oil feed pipe (43) is readily increased in the heating heat exchanger (74). On the other hand, the temperature of the liquid refrigerant having passed through the oil feed pipe (43) is hardly increased. Further, the liquid refrigerant, which has been reduced in pressure in the on-off valve (70), will not be superheated so much in the heating heat exchanger (74). Therefore, the temperature of the liquid refrigerant is increased very little. Thus, in Example Embodiment 3, the difference in temperature on the downstream side of the heating heat exchanger (74) (the detected temperature by the temperature sensor) is more remarkable between the oil and the liquid refrigerant flowing in the oil feed pipe (43).

For the foregoing reasons, in a transition of the state where the oil flows in the oil feed pipe (43) to the state where the liquid refrigerant flows therein, the detected temperature output to the control section (80) significantly decreases. When the amount of a decrease in detected temperature becomes larger than the specified amount in the control section (80), it is determined that the liquid refrigerant enters from the oil separator (22) to the oil feed pipe (43). This makes the control section (80) to close the on-off valve (70). Thus, the on-off valve (70) prevents the liquid refrigerant from flowing into the oil feed pipe (43).

Continuation of the operation in this state gradually raises the level of the oil in the oil separator (22). When the oil level exceeds the upper limit level H, the upper limit float switch (72) is operated to cause the on-off valve (70) to be opened, similarly to the case in Example Embodiment 1. Accordingly, the oil in the oil separator (22) is sent to the compressor (32) through the oil feed pipe (43) to allow the oil level to decrease again. Thus, inflow of the oil to the outflow pipe (42) can be avoided. Therefore, only the liquid refrigerant is supplied to the indoor heat exchangers (51*a*, 51*b*, 51*c*).

Advantages of Example Embodiment 3

In Example Embodiment 3, the temperature of the fluid having been heated by the heating heat exchanger (74) is detected in the oil feed pipe (43), and entering of the liquid refrigerant to the oil feed pipe (43) is detected based on the amount of a decrease in the temperature. When it is determined that the liquid refrigerant enters the oil feed pipe (43), the on-off valve (70) is closed quickly. Accordingly, also in the present example embodiment, the liquid refrigerant can be sufficiently supplied to the indoor heat exchangers (51*a*, 51*b*, 51*c*) in the cooling operation, thereby ensuring the cooling capacities of the indoor heat exchangers (51*a*, 51*b*, 51*c*).

Furthermore, with the heating heat exchanger (74) provided, even if the liquid refrigerant enters into the oil feed pipe (43), the liquid refrigerant can be evaporated by the heating heat exchanger (74). This can further ensure prevention of the liquid compression phenomenon in the compressor (32).

In addition, the refrigerant flowing out from the radiator (21) in the cooling operation can be cooled in the heating heat exchanger (74), thereby subcooling this refrigerant. Thus, the cooling capacities of the indoor heat exchangers (51*a*, 51*b*, 51*c*) can be further increased.

Modified Examples of Example Embodiment 3

The heating heat exchanger (74) in Example Embodiment 3 may be disposed at the following locations.

Figure 6:
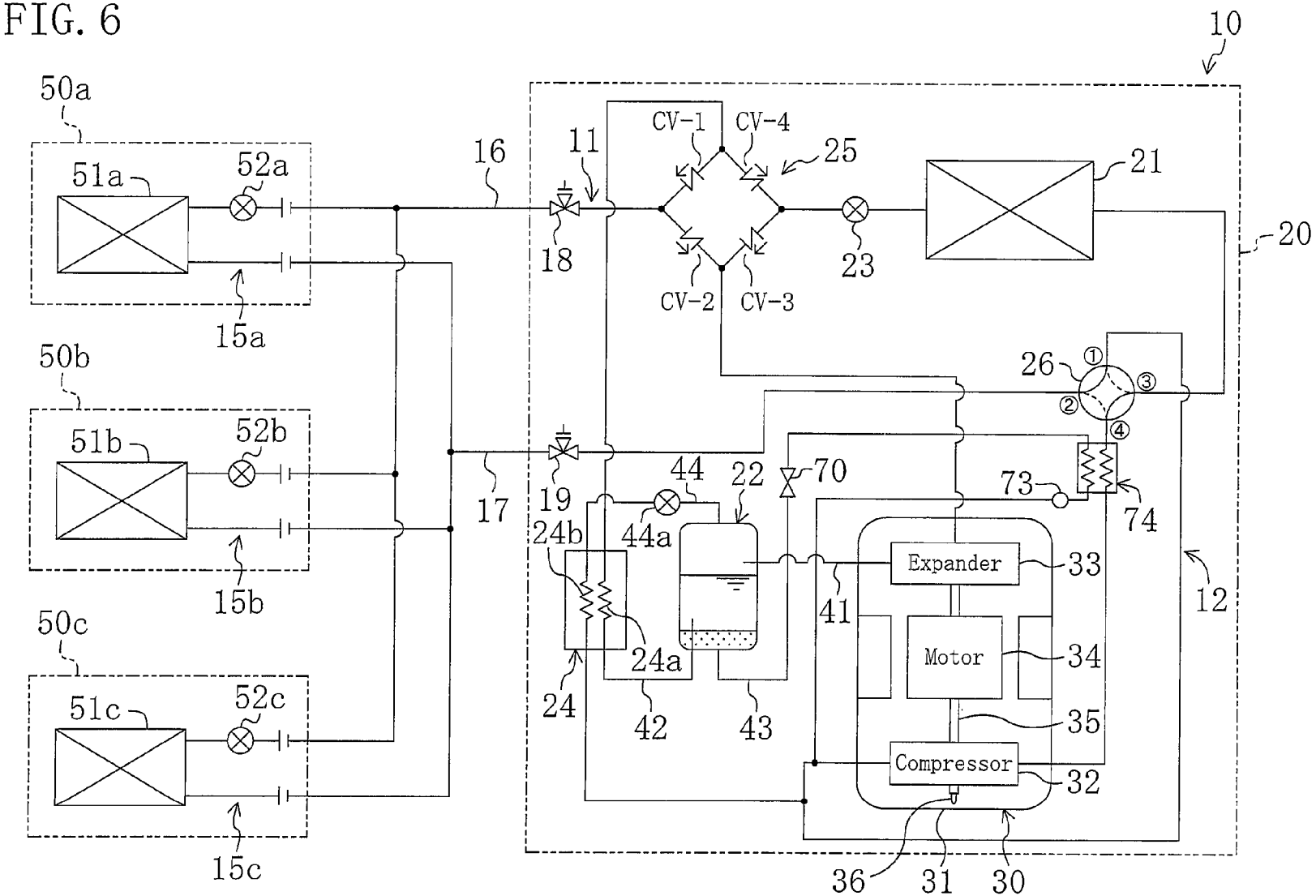
FIG. 6 is a diagram of a piping system showing a schematic configuration of an air conditioner according to Modified Example 1 of Example Embodiment 3.

In the example shown in FIG. 6, the heating heat exchanger (74) is disposed across the oil feed pipe (43) and the discharge pipe of the compressor (32). That is, the heating heat exchanger (74) performs heat exchange between the fluid flowing in the oil feed pipe (43) and the refrigerant discharged from the compressor (32). In this example, the other configurations and the opening control on the oil feed pipe (43) are the same as those in Example Embodiment 3.

In heating heat exchanger (74) in this example, the high pressure refrigerant on the discharge side of the compressor (32) heats the fluid flowing in the oil feed pipe (43). This increases the amount of heat to the fluid more than that in Example Embodiment 3. Therefore, the difference in temperature detected by the temperature sensor (73) is more remarkable between the oil flowing in the oil feed pipe (43) and the liquid refrigerant flowing therein. Thus, in this example, detection of entering of the liquid refrigerant to the oil feed pipe (43) can be ensured further.

Figure 7:
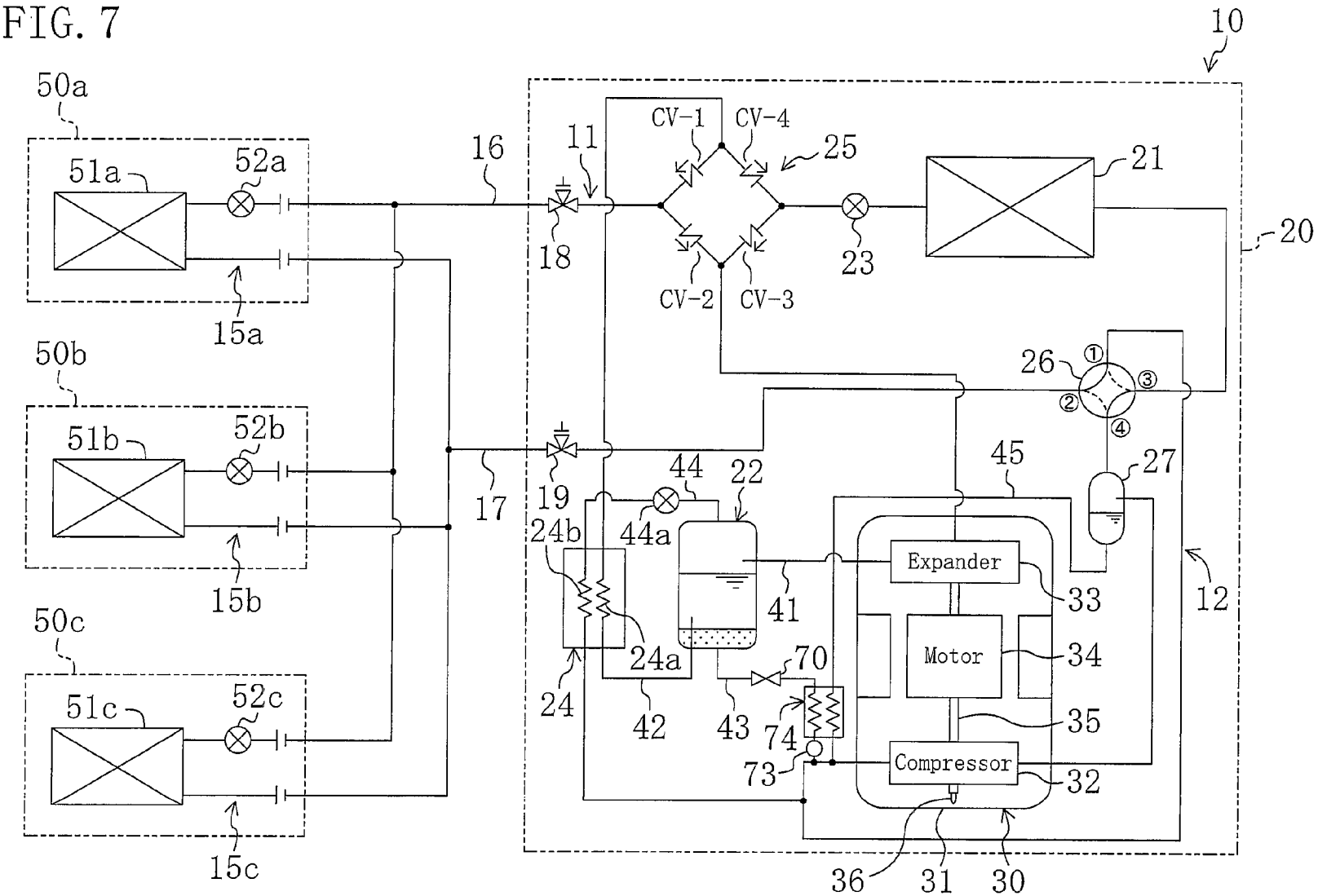
FIG. 7 is a diagram of a piping system showing a schematic configuration of an air conditioner according to Modified Example 2 of Example Embodiment 3.
Figure 8:
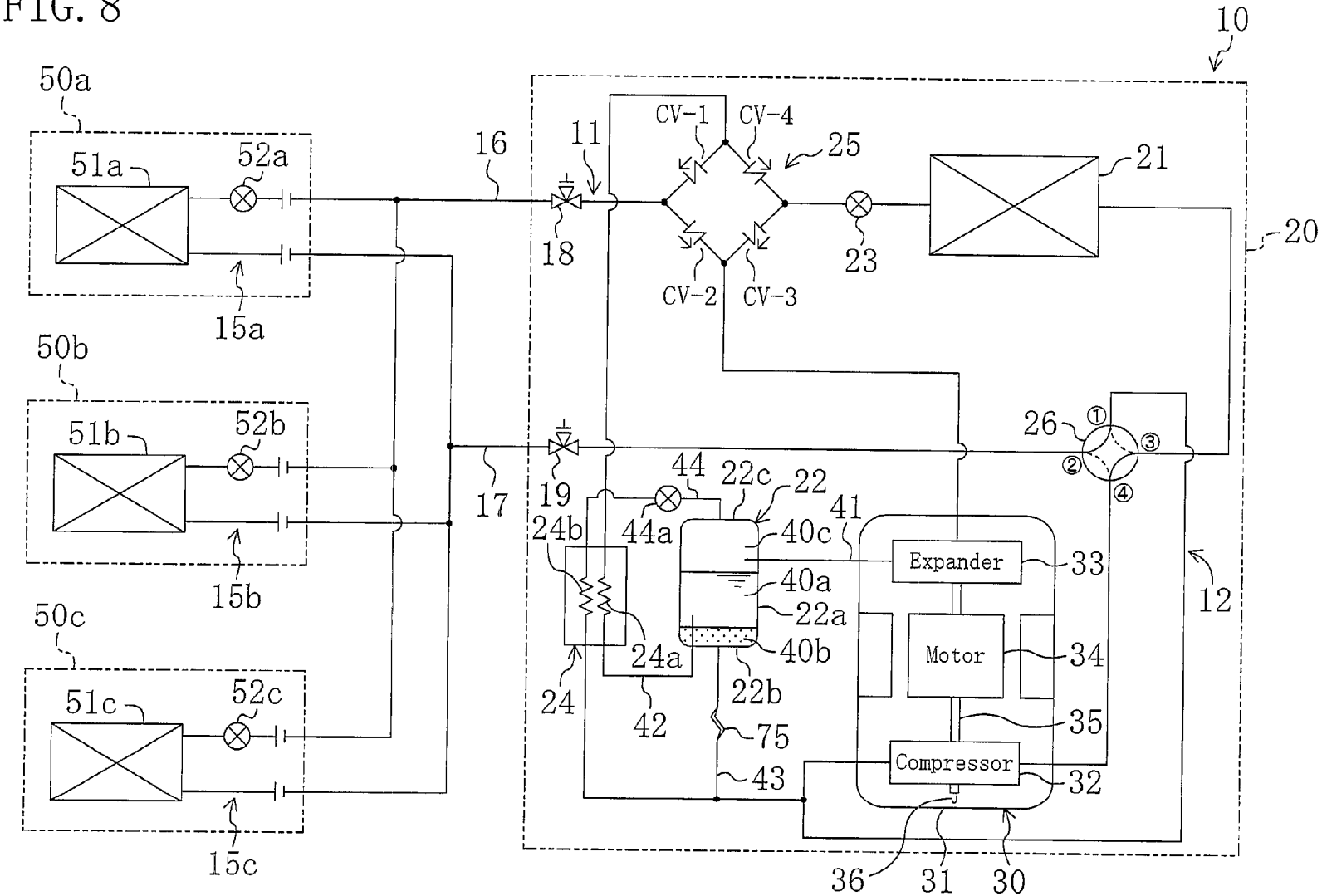
FIG. 8 is a diagram of a piping system showing a schematic configuration of an air conditioner according to Example Embodiment 4.

Alternatively, in a refrigerant circuit (11) shown in FIG. 7, a high pressure side oil separator (27) is provided on the discharge side of the compressor (32). The high pressure side oil separator (27) separates the oil from the refrigerant discharged from the compressor (32). Further, the refrigerant circuit (11) in this example includes an oil return pipe (45) having one end connected to the bottom of the high pressure side oil separator (27) and the other end connected to the suction side of the compressor (32). The oil return pipe (45) configures an oil return path for returning the oil separated in the high pressure side oil separator (27) to the suction side of the compressor (32). The heating heat exchanger (74) is disposed across the oil feed pipe (43) and the oil return pipe (45). That is, the heating heat exchanger (74) performs heat exchange between the fluid flowing in the oil feed pipe (43) and the oil flowing in the oil return pipe (45). In this example, the other configurations and the opening control on the oil feed pipe (43) are the same as those in Example Embodiment 3.

In the heating heat exchanger (74) in this example, the high temperature oil flowing in the oil return pipe (45) heats the fluid flowing in the oil feed pipe (43). This increases the amount of heat to the fluid more than that in Example Embodiment 3. Therefore, the difference in temperature detected by the temperature sensor (73) is more remarkable between the oil flowing in the oil feed pipe (43) and the liquid refrigerant flowing therein. Thus, in this example, detection of entering of the liquid refrigerant to the oil feed pipe (43) can be ensured further.

In addition, the fluid flowing in the oil feed pipe (43) may be heated by any other heating sections, such as a heater, for example, in place of the heating heat exchanger (74) in Example Embodiment 3.

Example Embodiment 4

In an air conditioner (10) according to Example Embodiment 4, a capillary tube (75) is provided as a refrigerant flow limiting section in the oil feed pipe (43) in place of the on-off valve (70) in each of the above example embodiments. Accordingly, the control section (80) for controlling the on-off valve (70) is omitted in Example Embodiment 4. The capillary tube (75) in Example Embodiment 4 provides predetermined resistance to the fluid flowing in the oil feed pipe (43). Therefore, even if the liquid refrigerant enters to the oil feed pipe (43) due to a decrease in amount of the oil in the oil separator (22), the capillary tube (75) limits the flow of the liquid refrigerant in the oil feed pipe (43). Thus, in Example Embodiment 4, such a comparatively simple configuration can suppress sending the liquid refrigerant in the oil separator (22) to the suction side of the compressor (32).

Example Embodiment 5

In an air conditioner (10) according to Example Embodiment 5, the on-off valve (70) is controlled so as to appropriately return the oil in the oil separator (22) to the compressor (32) even without the float switches (71, 72) in Example Embodiment 1.

Figure 9:
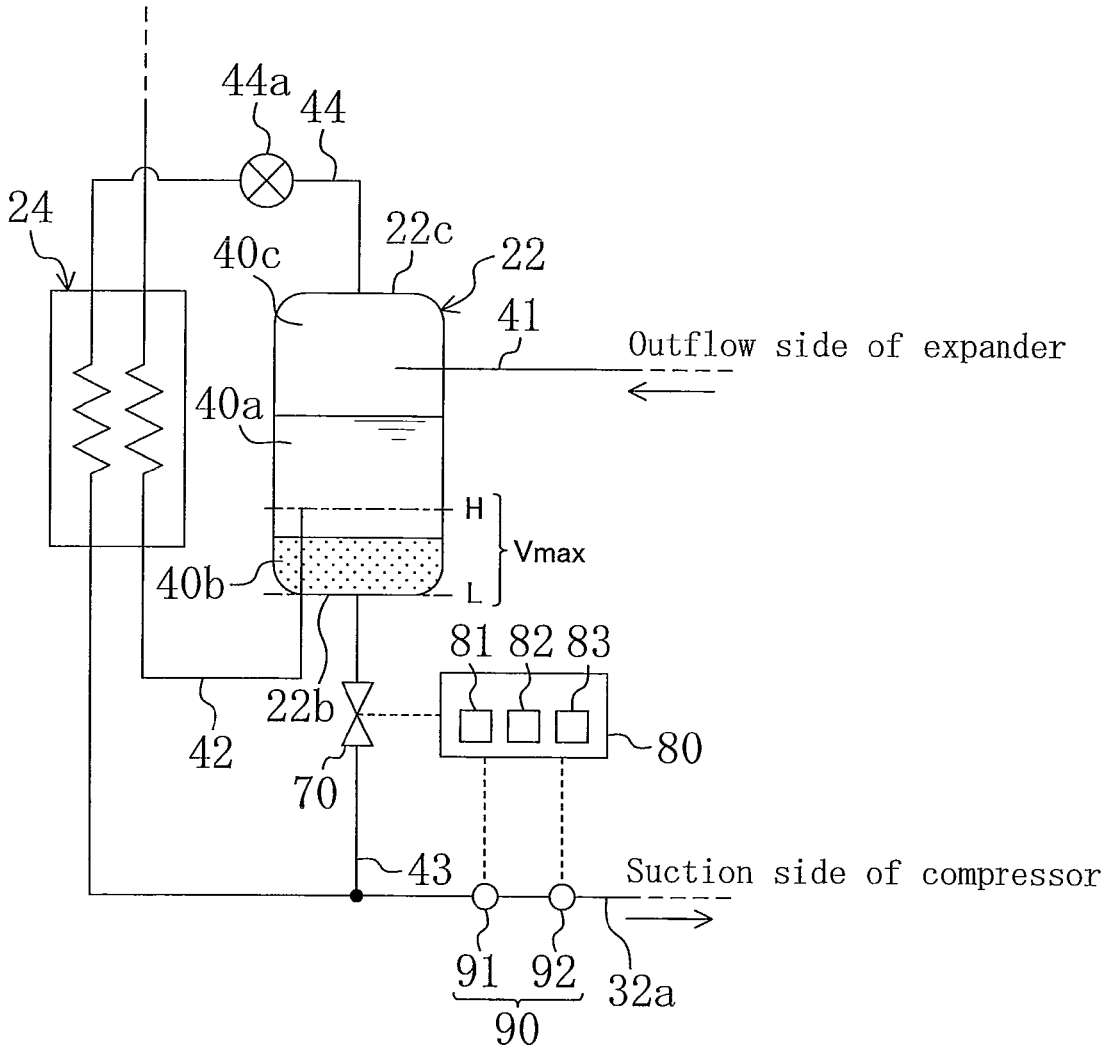
FIG. 9 is a diagram of a piping system showing the vicinity of an oil separator of an air conditioner according to Example Embodiment 5.

Specifically, the air conditioner (10) of Example Embodiment 5 shown in FIG. 9 includes the same refrigerant circuit (11) as that in Example Embodiment 1. The oil pool (40*b*) of the oil separator (22) is connected to the pipe (suction pipe (32*a*)) on the suction side of the compressor (32) through the oil feed pipe (43). In the oil feed pipe (43), a closable on-off valve (70) is provided. The channel area of the on-off valve (70) in the opened state is smaller than that of the oil feed pipe (43) so as to throttle the fluid flowing through the path for providing resistance to the fluid. That is, the on-off valve (70) serves also a pressure reduction mechanism that reduces the pressure of the fluid flowing in the oil feed pipe (43).

The refrigerant circuit (11) in Example Embodiment 5 includes a superheat degree detection section (90) configured to detect the degree of superheat of the refrigerant on the suction side of the compressor (32). Specifically, the superheat degree detection section (90) includes a to-be-sucked refrigerant temperature sensor (91) that detects the temperature of the refrigerant flowing in the suction pipe (32*a*) of the compressor (32), and a low-pressure pressure sensor (92) that detects the pressure of the refrigerant on the suction side (low pressure side) of the compressor (32). That is, the superheat degree detection section (90) derives the degree Tsh of superheat of the refrigerant on the suction side of the compressor (32) from the difference between the saturation temperature equivalent to the pressure of the low pressure detected by the low-pressure pressure sensor (92) and the temperature of the to-be-sucked refrigerant detected by the to-be-sucked refrigerant temperature sensor (91).

The control section (80) in Example Embodiment 5 configures a valve control section that performs on-off control on the on-off valve (70). Here, in the present example embodiment, the superheat degree detection section (90) configures a refrigerant detection section that detects entering of the liquid refrigerant from the oil separator (22) to the oil feed pipe (43) in the state where the on-off valve (70) is opened. That is, the control section (80) in the present example embodiment determines, after the on-off valve (70) is opened, whether the on-off valve (70) should be closed or not on the basis of the degree Tsh of superheat of the refrigerant on the suction side of the compressor (32). More specifically, a predetermined temperature variation amount ΔTstd to which the temperature varies in a predetermined time period is set in the control section (80). In the state where the on-off valve (70) is opened, when the variation amount ΔTsh of the degree of superheat of the refrigerant in the predetermined time period exceeds ΔTstd, the on-off valve (70) is closed. This will be described in detail with reference to FIG. 10.

Once the on-off valve (70) is in the opened state from a time point ton, the oil in the oil separator (22) flows out into the oil feed pipe (43). Here, when the oil passes through the on-off valve (70), the pressure of the oil is reduced to slightly decrease the temperature T' of the fluid in the oil feed pipe (43) on the downstream side of the on-off valve (70). On the other hand, even when the oil in the oil separator (22) flows out into the suction pipe (32*a*) through the oil feed pipe (43), the degree Tsh of superheat of the refrigerant detected by the superheat degree detection section (90) varies little. In other words, the degree Tsh of superheat of the refrigerant in the refrigerant circuit (11) receives little influence of the oil after pressure reduction, and slightly decreases.

Thereafter, when the oil in the oil separator (22) is exhausted, and the liquid refrigerant flows out into the oil feed path (43), the on-off valve (70) reduces the pressure of the liquid refrigerant, thereby cooling the liquid refrigerant up to a temperature lower than that of the oil. Then, the degree Tsh of superheat of the refrigerant in the refrigerant circuit (11) is decreased significantly by influence of the liquid refrigerant flowing out to the suction pipe (32*a*) through the oil feed pipe (43). When the variation amount ΔTsh of the degree of superheat of the refrigerant in the predetermined time period exceeds the variation amount ΔTstd as a reference, the control section (80) determines that the liquid refrigerant enters the oil feed pipe (43), and closes the on-off valve (70) (time point toff). Consequently, suction of a large amount of the liquid refrigerant from the oil separator (22) to the compressor (32) can be avoided. Thereafter, the oil is gradually accumulated in the oil separator (22).

As described above, in the present example embodiment, entering of the liquid refrigerant from the oil separator (22) to the oil feed pipe (43) is detected based on variation in degree of superheat of the refrigerant on the suction side of the compressor (32). This can further ensure detection of entering of the liquid refrigerant, and can eliminate the need to provide an additional sensor besides the sensor for detecting the degree of superheat of the refrigerant. That is, in the present example embodiment, entering of the liquid refrigerant from the oil separator (22) to the oil feed pipe (43) can be detected easily and reliably without increasing the number of components, such as sensors, for example.

In addition, the control section (80) in the present example embodiment includes a close time timer (81), an open time counter (82), and an oil flow rate estimating section (83). In the close time timer (81), a time period (close time tc) from closing to opening of the on-off valve (70) is set. That is, the control section (80) is configured to temporarily open the on-off valve (70) every time the preset close time tc elapses. A time period experimentally obtained in advance on the basis of the amount of oil leakage in normal operation of the compressor (32), and the like is set as the initial value of the close time tc.

Figure 10:
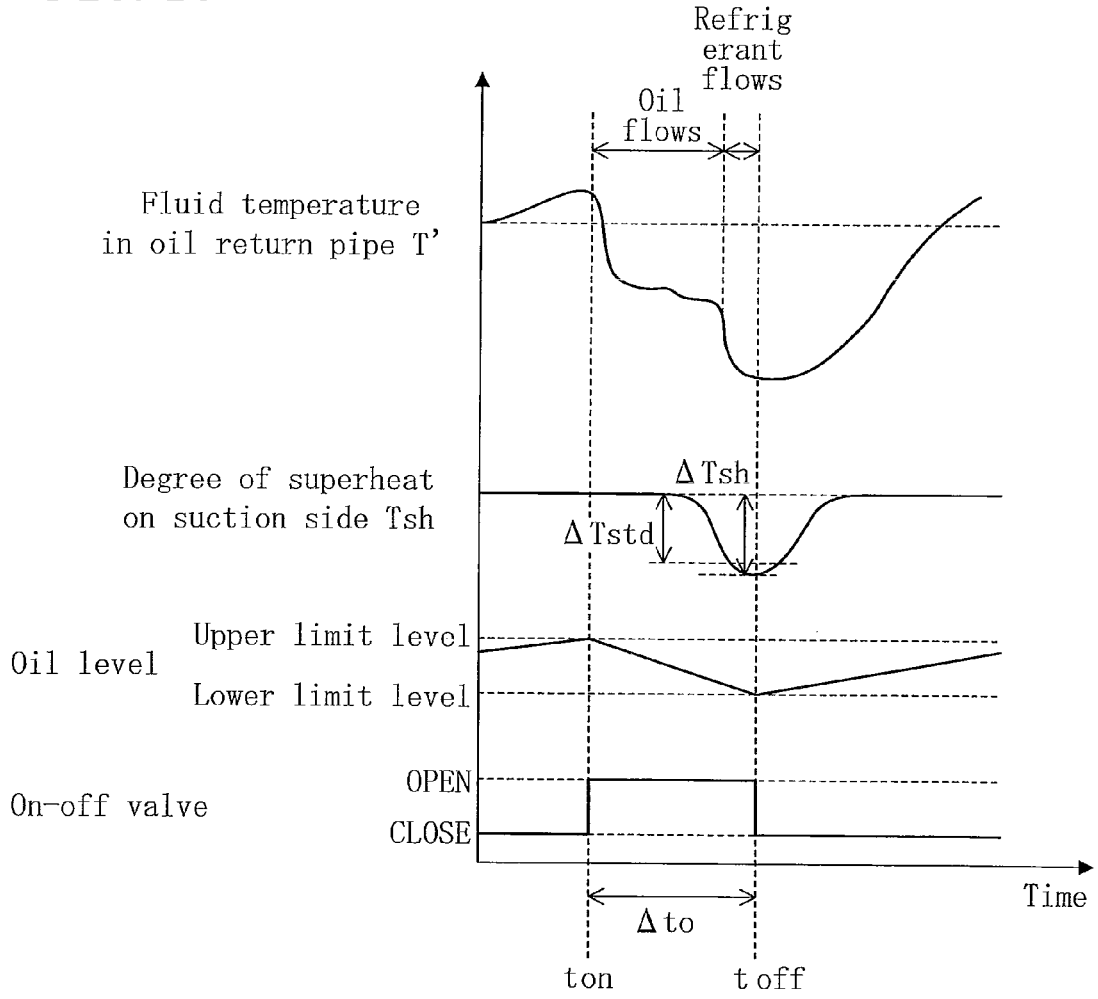
FIG. 10 illustrates time charts indicating variations in degree of superheat of refrigerant, temperature of fluid, oil level in the oil separator, and on-off state of an on-off valve in the air conditioner according to Example Embodiment 5.

The open time counter (82) measures the time period from opening to closing of the on-off valve (70) every time. That is, the open time counter (82) is configured to always measure and store a time period (Δto) from time (ton) when the on-off valve (70) is opened to time (toff) when the variation amount ΔTsh of the degree of superheat of the refrigerant exceeds ΔTstd and the on-off valve (70) is closes, as shown in FIG. 10.

Furthermore, the oil flow rate estimating section (83) is configured to estimate and calculate the theoretical flow rate (discharge flow rate W) of the oil discharged from the oil separator (22) to the oil feed pipe (43) in the state where the on-off valve (70) is opened. Here, the discharge flow rate W [$m^3/s$] is a volume flow rate of the oil, and can be calculated from the following expression, for example.

[Expression 1]

$$W = Cv \times Ao \times \sqrt{\frac{2 \times \Delta P}{\rho}} \tag{1}$$

Here, Cv in Expression (1) is a flow rate factor, and can be obtained from a relational expression (Cv=f(To)) using the oil temperature To, for example. In Expression (1), Ao is a cross-channel area [$m^2$] of the on-off valve (70). In Expression (1), ΔP is a difference between the intermediate pressure Pm and the low pressure P1 of the refrigerant circuit (11). Here, Pm is a pressure acting inside the oil separator (22), that is, the intermediate pressure [Pa] of the refrigerant circuit (11). Accordingly, by providing a pressure sensor at a line (e.g., the inflow pipe (41) of the oil separator (22) or the like) in the refrigerant circuit (11) on which the intermediate pressure acts, the intermediate pressure Pm can be detected. Further, P1 is a pressure [Pa] of the low pressure of the refrigerant circuit (11), and can be detected by the aforementioned low-pressure pressure sensor (92), for example. In Expression (1), ρ is a density [$kg/m^3$] of the oil.

The oil flow rate estimating section (83) is configured to calculate, from Expression (1), the discharge flow rate W of the oil separator (22) in the opened state of the on-off valve (70) according to variations in the intermediate pressure Pm and the low pressure P1 of the refrigerant circuit (11). Alternatively, the discharge flow rate W may be calculated using Expression (2) below as a simplified expression of Expression (1).

[Expression 2]

$$W = \sqrt{\frac{\Delta P}{\rho}} \tag{2}$$

Furthermore, the discharge flow rate W may be calculated using a logical expression or an experimental expression other than Expressions (1) and (2). Alternatively, the discharge flow rate W may be obtained with another parameter (e.g. oil viscosity, etc.) taken into consideration.

The control section (80) in Example Embodiment 5 is configured to correct the close time tc of the on-off valve (70) according to the open time Δto measured by the open time counter (82) and the discharge flow rate W in this open time Δto. Accordingly, the amount of the oil accumulated in the oil separator (22) in the closed time of the on-off valve (70) is controlled to approximate an appropriate amount, namely, an oil retention amount Vmax as a reference.

Specifically, the volume (the reference oil retention amount Vmax) of the oil between the upper limit level H and the lower limit level L of the oil separator (22) is set in the control section (80), as shown in FIG. 9. The control section (80) calculates the theoretical open time Δtoi by dividing Vmax by the discharge flow rate W. Further, the control section (80) compares this theoretical open time Δtoi with the open time Δto in the corresponding time period. When the open time Δto is shorter than the theoretical open time Δtoi, the control section (80) corrects the close time Δtc by increasing it. Conversely, when the open time Δto is longer than the theoretical open time Δtoi, the control section (80) corrects the close time Δtc by reducing it. Such correction of the close time tc will be described further in detail with reference to FIG. 11.

As described above, the control section (80) in the present example embodiment controls the opening operation of the on-off valve (70) by referencing the close time timer (81). This achieves periodical discharge of the oil in the oil separator (22) without using the upper limit float switch (72) unlike Example Embodiment 1, for example, thereby achieving simplification of the apparatus configuration. Incidentally, the amount of the oil accumulated in the oil separator (22) varies depending on the amount of oil leakage in the compressor (32), and the like. Therefore, only the time control according to the close time timer (81) cannot accumulate an appropriate amount (i.e., Vmax) of the oil in the oil separator (22). For this reason, the on-off valve (70) may be opened even when the amount of the oil retained in the oil separator (22) does not reach Vmax, thereby increasing the frequency of the on/off operation. Further, the amount of the oil retained in the oil separator (22) may exceed Vmax, thereby allowing the oil in the oil separator (22) to flow out into the outflow pipe (44). In view of this, that is, in order to address such disadvantages, in the present example embodiment, the amount of the oil retained in the oil separator (22) approximates Vmax by correcting the close time Δtc so as to correspond to a variation of the amount of the oil leakage.

Specifically, when the control section (80) closes the on-off valve (70) at a time point toff1, discharge of the oil from the oil separator (22) terminates, thereby gradually accumulating the oil in the oil separator (22). This closed state of the on-off valve (70) continues until the preset close time Δtc (Δtck) elapses. Here, where the amount of oil leakage in the compressor (32) is a standard amount, for example, as shown in, FIG. 11(A), the level of the oil in the oil separator (22) just agrees with the upper limit level immediately before the on-off valve (70) is opened (time point ton1). That is, in this case, the oil accumulates to the amount of Vmax in the oil separator (22) when the close time Δtck elapses.

Figure 11A:
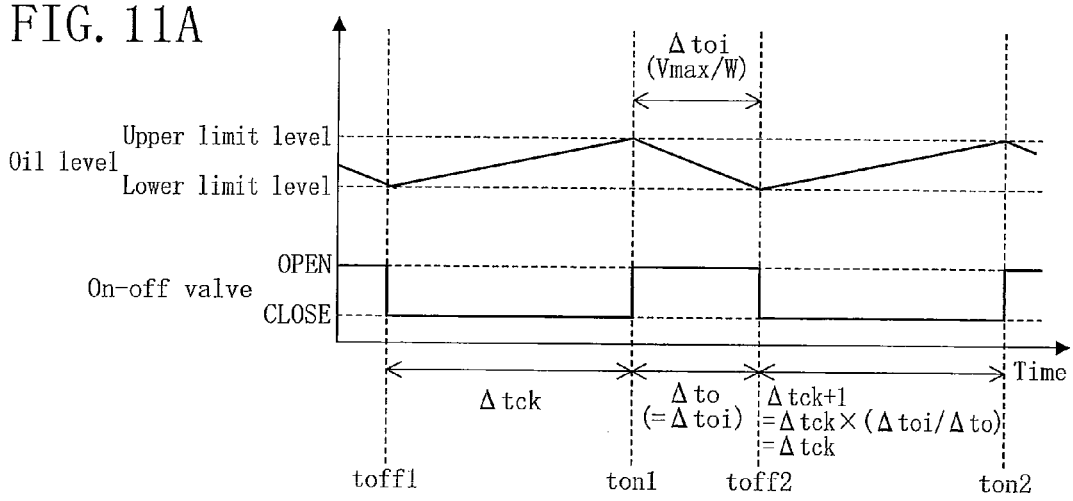

In the case as shown in FIG. 11(A), even if the close time Δtck+1 from on-off valve (70) closing at the next time point toff2 to its opening at a time point ton2 is the same as the previous close time Δtck, the oil can be accumulated up to the reference oil retention amount Vmax in the oil separator (22). Therefore, no correction is performed on the next close time Δtck+1.

Specifically, once the on-off valve (70) is opened at the time point ton1, it is not closed until the time point (time point toff2) when the variation amount ΔTsh of the degree of superheat of the refrigerant exceeds the reference variation amount ΔTstd, as showin in FIG. 10. The time period it takes during this time is measured and stored as an open time Δto in the open time counter (82). At the same time, the oil flow rate estimating section (83) calculates the discharge flow rate W in this time period (time period of Δto) by the above mentioned expression on the basis of the pressure difference ΔP in the refrigerant circuit (11) and the like. Next, the control section (80) divides the reference retention amount Vmax by the discharge flow rate W to calculate an open time (i.e., a theoretical open time Δtoi) of the on-off valve (70) necessary for thoroughly discharging the oil of the amount of Vmax where the oil of the amount Vmax is retained in the oil separator (22). Then, the control section (80) corrects the next close time Δtck+1 after the on-off valve (70) is closed by the following expression.

$$\Delta tc\mathit{k}+1=\Delta tc\mathit{k}\times(\Delta to\mathit{i}/\Delta to). \quad (3)$$

That is, the control section (80) multiplies the previous close time Δtck by a value as a correction factor obtained by dividing the theoretical open time Δtoi by the actually measured open time Δto, thereby correcting the next close time Δtck+1.

Here, as shown in FIG. 11(A), if the oil of the amount Vmax is accumulated in the oil separator (22) when the initial close time Δtck elapses, the theoretical open time Δtoi almost agrees with the actual open time Δto. Accordingly, in this case, the correction factor becomes 1 (=Δtoi/Δto). Therefore, no correction is performed on the next close time Δtck+1. Consequently, unless the amount of oil leakage varies abruptly, the oil can be accumulated in the oil separator (22) up to the reference oil retention amount Vmax in the time period of the next close time Δtck+1.

Figure 11B:
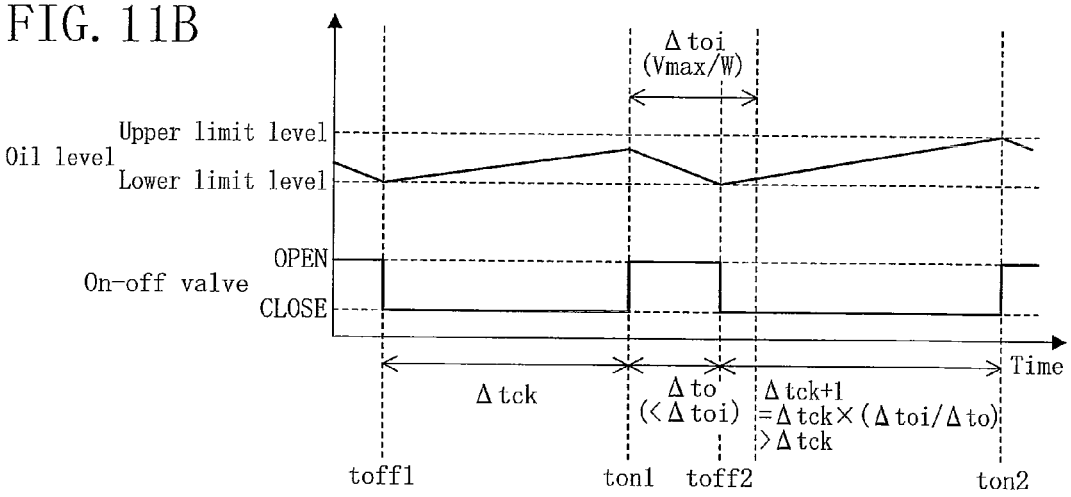

Next, as shown in, for example, FIG. 11(B), when the amount of oil leakage in the compressor (32) is smaller than the average oil leakage amount, the level of the oil in the oil separator (22) is lower than the upper limit level immediately before the on-off valve (70) is opened (time point ton1). That is, in this case, the amount of the oil retained in the oil separator (22) when the close time Δtc elapses is smaller than Vmax.

In the case as shown in FIG. 11(B), if the close time Δtck+1 when the on-off valve (70) is closed next time is set to be the same as the previous close time Δtck, the oil cannot be accumulated up to the reference retention amount Vmax in the oil separator (22). In view of this, the control section (80) corrects the next close time Δtck+1 to be longer than the previous close time Δtck.

Specifically, once the on-off valve (70) is opened at the time point ton1, similarly to the above, the actual open time Δto of the on-off valve (70) is measured and stored. At the same time, the oil flow rate estimating section (83) calculates the discharge flow rate W in this time period (time period of Δto) by the above mentioned expression on the basis of the pressure difference ΔP in the refrigerant circuit (11) and the like. Next, the control section (80) divides the reference retention amount Vmax by the discharge flow rate W to calculate an open time (i.e., a theoretical open time Δtoi) of the on-off valve (70) necessary for thoroughly discharging the oil of an amount Vmax where the oil of the amount Vmax is accumulated in the oil separator (22). Then, the control section (80) calculates the next close time Δtck+1 after the on-off valve (70) is closed by the aforementioned expression (3) (Δtck+1=Δtck×(Δtoi/Δto)).

Here, as shown in FIG. 11(B), if the amount of the oil in the oil separator (22) when the initial close time Δtck elapses is smaller than Vmax, the actual open time Δto is shorter than the theoretical open time Δtoi. Therefore, in this case, the correction factor is smaller than 1 (Δtoi/Δto >1). Accordingly, correction for increasing the next close time Δtck+1 is performed. Consequently, in the time period of the next close time Δtck+1, the amount of the oil accumulated in the oil separator (22) increases to approximate Vmax.

Figure 11C:
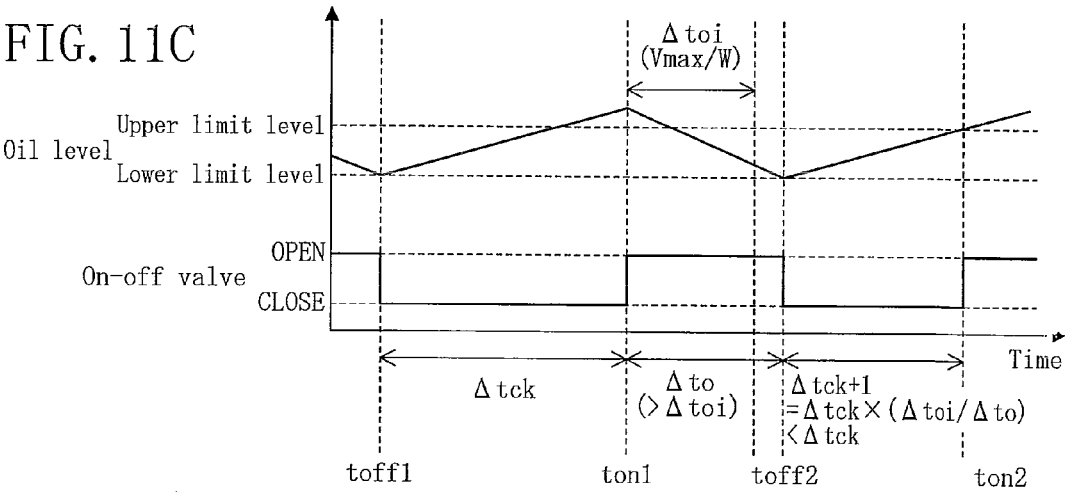

Next, as shown in, FIG. 11(C), for example, when the amount of oil leakage in the compressor (32) is larger than the average oil leakage amount, the level of the oil in the oil separator (22) is higher than the upper limit level immediately before the on-off valve (70) is opened (time point ton1). That is, in this case, the amount of the oil retained in the oil separator (22) when the close time Δtc elapses is larger than Vmax.

In the case as shown in FIG. 11(C), if the close time Δtck+1 when the on-off valve (70) is closed next time is set to be the same as the previous close time Δtck, the amount of the oil in the oil separator (22) exceeds the reference retention amount Vmax. In view of this, the control section (80) corrects the next close time Δtck+1 to be shorter than the previous close time Δtck.

Specifically, once the on-off valve (70) is opened at the time point ton1, similarly to the above, the actual open time Δto of the on-off valve (70) is measured and stored. At the same time, the oil flow rate estimating section (83) calculates the discharge flow rate W in this time period (time period of Δto) by the above mentioned expression on the basis of the pressure difference ΔP in the refrigerant circuit (11) and the like. Next, the control section (80) divides the reference retention amount Vmax by the discharge flow rate W to calculate an open time (i.e., a theoretical open time Δtoi) of the on-off valve (70) necessary for thoroughly discharging the oil of an amount Vmax where the oil of the amount Vmax is accumulated in the oil separator (22). Then, the control section (80) calculates the next close time Δtck+1 after the on-off valve (70) is closed by the above expression (3) (Δtck+1=Δtck×(Δtoi/Δto)).

Here, as shown in FIG. 11(C), if the amount of the oil in the oil separator (22) when the initial close time Δtck elapses is larger than Vmax, the actual open time Δto is longer than the theoretical open time Δtoi. Therefore, in this case, the correction factor is larger than 1 (Δtoi/Δto <1). Accordingly, correction for reducing the next close time Δtck+1 is performed. Consequently, in the time period of the next close time Δtck+1, the amount of the oil accumulated in the oil separator (22) decreases to approximate Vmax.

As discussed above, in the present example embodiment, the opening operation of the on-off valve (70) is controlled using the close time timer (81), while at the same time the close time Δtc is appropriately corrected based on the open time Δto and the discharge flow rate W. Accordingly, in the present example embodiment, the amount of the oil in on-off valve (70) closing can approximate the reference oil retention amount Vmax even if the oil leakage amount and the like vary. This can prevent the on-off valve (70) from being opened when the oil retention amount does not yet reach Vmax, thereby preventing shortening of the mechanical lifetime of the on-off valve (70) caused due to unnecessary opening/closing operation of the on-off valve (70). Further, a decreases in oil separation rate of the oil separator (22) caused due to the oil retention amount exceeding Vmax can be prevented, and outflow of the oil to the outflow pipe (44) can be avoided. Consequently, reliability of the air conditioner (10) can be increased.

In the present example embodiment, entering of the liquid refrigerant from the oil separator (22) to the oil feed pipe (43) is detected based on the degree of superheat of the refrigerant on the suction side of the compressor (32). However, the other refrigerant detection sections described in the other example embodiments may be replaced therewith for detection. In such a case, similar correction of the close time Δtc as shown in FIG. 11 can be performed.

Other Example Embodiments

The refrigerating apparatuses of the above example embodiments can have the following configurations.

Figure 12:
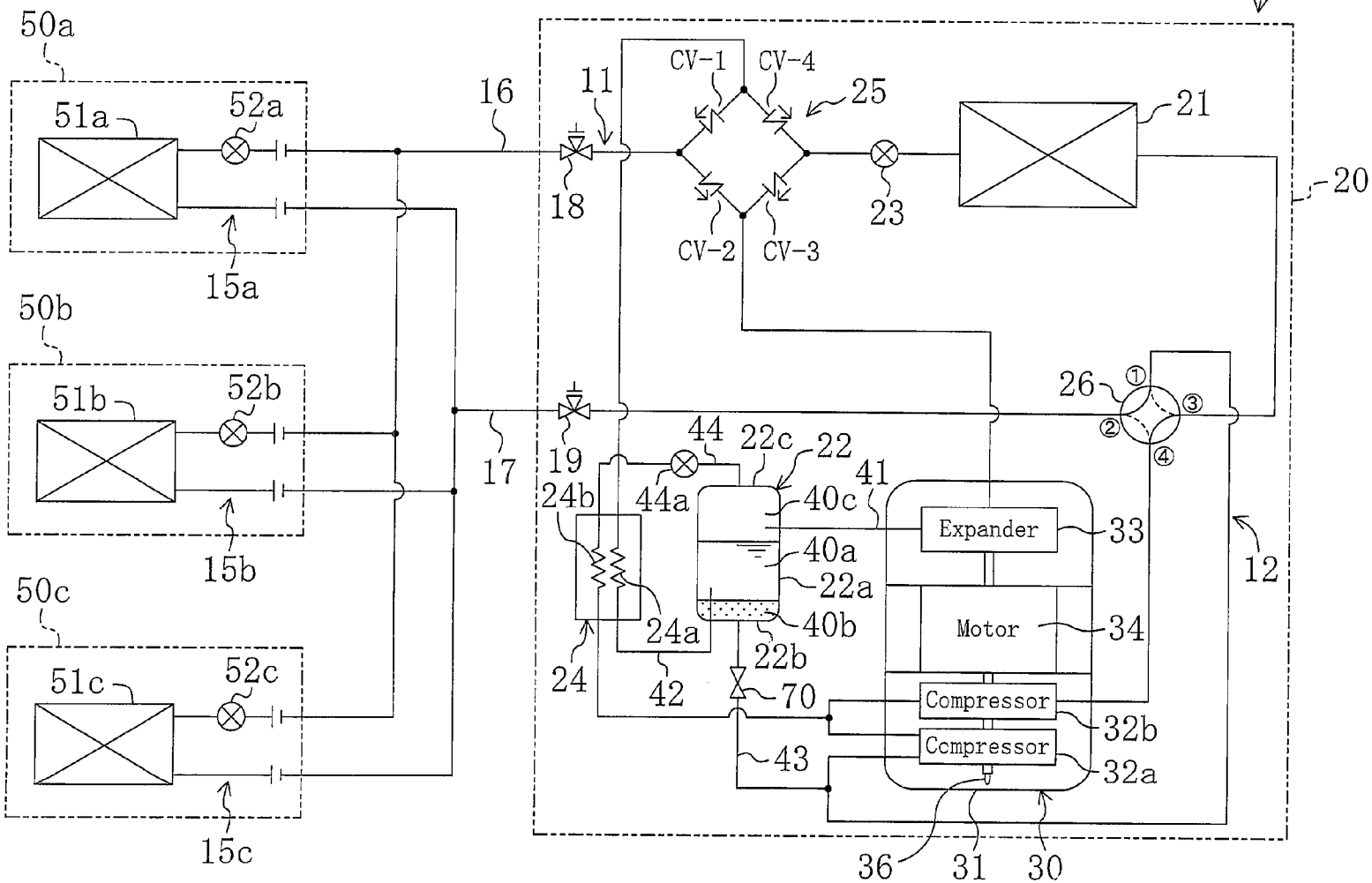
FIG. 12 is a diagram of a piping system showing a schematic configuration of an air conditioner according to another example embodiment.

As shown in FIG. 12, the present invention may be applied to a refrigerating apparatus (10) including a plurality of compressors (32*a*, 32*b*) for performing a two-stage compression refrigeration cycle. In the example shown in FIG. 12, a lower compressor (32*a*) is provided near the lower end of the drive shaft (35), and an upper compressor (32*b*) is provided above the lower compressor (32*a*). Further, in this air conditioner (10), after the low pressure refrigerant is sucked to the lower compressor (32*a*) and is compressed up to the intermediate pressure, it is further compressed up to the high pressure in the upper compressor (32*b*). The outflow end of the gas injection pipe (44) is connected to an intermediate pressure pipe between the discharges side of the lower compressor (32*a*) and the upper compressor (32*b*). Further, the oil feed pipe (43) connects the bottom of the oil separator (22) to the suction side of the lower compressor (32*a*). In this example, also, similar control to that in Example Embodiment 1 on the on-off valve (70) in the oil feed pipe (43) can avoid sending the liquid refrigerant to the suction side of the lower compressor (32*a*). It is noted that the refrigerant flow limiting section in Example Embodiments 2 to 4 can be applied to the air conditioner (10) performing such a two-stage compression refrigeration cycle, of course.

Moreover, in each of the above example embodiments, the on-off valve (70) of a solenoid valve is used as the opening adjustment mechanism for adjusting the opening of the oil feed pipe (43). However, a flow rate adjusting valve (expansion valve) capable of finely adjusting its opening may be used as the opening adjustment mechanism. In this case, when the amount of the oil in the oil separator (22) decreases, or when the oil level becomes low, the opening of the flow rate adjusting valve is controlled to be reduced, or the valve is closed fully. Conversely, when the amount of the oil in the oil separator (22) increases, or when the oil level becomes high, the opening of the flow rate adjusting valve is controlled to be increased, or the valve is opened fully In addition, the present invention is applied to a multi type refrigerating apparatus including a plurality of indoor units (50*a*, 50*b*, 50*c*) in each of the above example embodiments, but may be applied to so-called pair type refrigerating apparatuses including a single indoor unit and a single outdoor unit. Further, any refrigerant other than carbon dioxide may be used as the refrigerant filled in the refrigerant circuit (11).

The above example embodiments are merely preferred examples, and are not intended to limit the scopes of the present invention, its applicable objects, and its use.

INDUSTRIAL APPLICABILITY

As described above, the present invention is useful for refrigerating apparatuses in which oil is separated from refrigerant flowing out from expanders and is sent to suction sides of compressors.

The invention claimed is:

1. A refrigerating apparatus, comprising:

a refrigerant circuit including a compressor, a radiator, an expander, and an evaporator for performing a refrigeration cycle, wherein the refrigerant circuit includes an oil separator configured to separate oil from two-phase gas/liquid refrigerant flowing out from the expander, and an oil feed path configured to send the oil separated by the oil separator and retained in a bottom of the oil separator to a suction side of the compressor, the refrigerating apparatus further comprising:

a refrigerant flow limiting section that limits a flow of fluid flowing in the oil feed path for preventing liquid refrigerant in the oil separator from being sucked to the compressor through the oil feed pipe.

2. The apparatus of claim 1, wherein the refrigerant flow limiting section includes a refrigerant detection section that detects entering of the liquid refrigerant from the oil separator to the oil feed path, and an opening adjustment mechanism that reduces the opening of the oil feed path when the refrigerant detection section detects entering of the liquid refrigerant.

3. The apparatus of claim 2, wherein the refrigerant detection section includes a pressure reduction mechanism that reduces a pressure of the fluid flowing in the oil feed path and a temperature sensor that detects a temperature of the fluid on a downstream side of the pressure reduction mechanism, and the refrigerant detection section is configured to detect entering of the liquid refrigerant to the oil feed path on the basis of a detected temperature of the temperature sensor.

4. The apparatus of claim 2, wherein the refrigerant detection section includes a heating section that heats the fluid flowing in the oil feed path and a temperature sensor that detects a temperature of the fluid on a downstream side of the heating section, and the refrigerant detection section is configured to detect entering of the liquid refrigerant to the oil feed path on the basis of a detected temperature of the temperature sensor.

5. The apparatus of claim 4, wherein the heating section is configured by a heating heat exchanger that performs heat exchange between the fluid flowing in the oil feed path and the refrigerant on an inflow side of the expander.

6. The apparatus of claim 4, wherein the heating section is configured by a heating heat exchanger that performs heat exchange between the fluid flowing in the oil feed path and the refrigerant on a discharge side of the compressor.

7. The apparatus of claim 4, wherein the refrigerant circuit includes a high pressure side oil separator that separates the oil from the refrigerant discharged from the compressor, and an oil return path that returns the oil separated in the high pressure side oil separator to a suction side of the compressor, and the heating section is configured by a heating heat exchanger that performs heat exchange between the fluid flowing in the oil feed path and the oil flowing in the oil return path.

8. The apparatus of claim 2, wherein the refrigerant detection section includes a pressure reduction mechanism that reduces a pressure of the fluid flowing in the oil feed path, and a superheat degree detection section that detects a degree of superheat of the refrigerant on a suction side of the compressor, and the refrigerant detection section is configured to detect entering of the liquid refrigerant to the oil feed path on the basis of the degree of superheat of the refrigerant detected by the superheat degree detection section.

9. The apparatus of claim 1, wherein the refrigerant flow limiting section includes an oil amount detection section that detects an amount of the oil in the oil separator, and an opening adjustment mechanism that adjusts an opening of the oil feed path according to the amount of the oil detected by the oil amount detection section.

10. The apparatus of claim 9, wherein the oil amount detection section is configured by an oil level detection section that detects a level of the oil in the oil separator, and the opening adjustment mechanism is configured to adjust the opening of the oil feed path according to the level of the oil detected by the oil level detection section.

11. The apparatus of claim 10, wherein the opening adjustment mechanism is configured to close the oil feed path when the level of the oil detected by the oil level detection section is lower than a predetermined level.

12. The apparatus of claim 1, wherein the refrigerant flow limiting section includes an on-off valve provided in the oil feed path, and a valve control section that temporarily opens the on-off valve every time a predetermined close time $\Delta tc$ in a state where the on-off valve is closed elapses.

13. The apparatus of claim 12, wherein the refrigerant flow limiting section includes a refrigerant detection section that detects entering of the liquid refrigerant from the oil separator to the oil feed path in a state where the on-off valve is opened, and the valve control section closes the on-off valve in an opened state when the refrigerant detection section detects entering of the liquid refrigerant.

14. The apparatus of claim 13, wherein the valve control section includes an open time measurement section that measures an open time $\Delta to$ from time when the on-off valve is opened to time when the on-off valve is closed, and the valve control section corrects the close time $\Delta tc$ according to the open time $\Delta to$ measured by the open time measurement section.

15. The apparatus of claim 14, wherein the valve control section includes an oil flow rate estimating section that estimates a discharge flow rate W of the oil discharged from the oil separator to the oil feed path when the on-off valve is opened, the valve control section is configured to calculate a theoretical open time $\Delta toi$, which is obtained by dividing an oil retention amount Vmax as a reference in the oil separator by the discharge flow rate W, and the valve control section corrects the close time $\Delta tc$ to be longer when the open time $\Delta to$ measured by the open time measurement section is shorter than the theoretical open time $\Delta toi$, and corrects the close time $\Delta tc$ to be shorter when the open time $\Delta to$ measured by the open time measurement section is longer than the theoretical open time $\Delta toi$.

16. The apparatus of claim 15, wherein the oil flow rate estimating section is configured to estimate the discharge flow rate W on the basis of a difference between a pressure acting inside the oil separator and a pressure on a suction side of the compressor.

17. The apparatus of claim 1, wherein the refrigerant flow limiting section is configured by a capillary tube provided in the oil feed path.

18. The apparatus of claim 1, wherein the oil separator is configured to separate two-phase gas/liquid refrigerant into liquid refrigerant and gas refrigerant, thereby supplying the liquid refrigerant to the evaporator.

19. The apparatus of claim 18, wherein the refrigerant circuit includes a gas injection path that sends the gas refrigerant separated by the oil separator to the suction side of the compressor.

20. The apparatus of claim 19, further comprising:

a gas flow rate adjustment mechanism that adjusts a flow rate of the gas refrigerant flowing in the gas injection path.

21. The apparatus of claim 20, further comprising:

an internal heat exchanger that performs heat exchange between the gas refrigerant having passed through the gas flow rate adjustment mechanism in the gas injection path and the refrigerant supplied from the oil separator to the evaporator.

* * * * *